US010941640B2

(12) United States Patent
Frosell et al.

(10) Patent No.: US 10,941,640 B2
(45) Date of Patent: Mar. 9, 2021

(54) MULTI-FUNCTIONAL SLEEVE COMPLETION SYSTEM WITH RETURN AND REVERSE FLUID PATH

(71) Applicant: Halliburton Energy Services, Inc., Houston, TX (US)

(72) Inventors: Thomas J. Frosell, Dallas, TX (US); Mark Douglas Macek, Tyler, TX (US); Colin E. Kappe, Covington, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/553,296

(22) Filed: Aug. 28, 2019

(65) Prior Publication Data

US 2020/0080404 A1 Mar. 12, 2020

Related U.S. Application Data

(60) Provisional application No. 62/727,774, filed on Sep. 6, 2018.

(51) Int. Cl.

| | |
|---|---|
| ***E21B 43/14*** | (2006.01) |
| ***E21B 43/04*** | (2006.01) |
| ***E21B 43/26*** | (2006.01) |
| ***E21B 33/124*** | (2006.01) |
| ***E21B 43/08*** | (2006.01) |
| *E21B 34/06* | (2006.01) |

(52) U.S. Cl.

CPC ..... *E21B 43/14* (2013.01); *E21B 33/124* (2013.01); *E21B 43/045* (2013.01); *E21B 43/08* (2013.01); *E21B 43/261* (2013.01); *E21B 34/06* (2013.01); *E21B 2200/06* (2020.05)

(58) Field of Classification Search

CPC ..... E21B 43/14
USPC ..... 166/271
See application file for complete search history.

(56) References Cited

U.S. PATENT DOCUMENTS

| | | | | |
|---|---|---|---|---|
| 6,782,948 | B2 | 8/2004 | Echols et al. | |
| 7,322,417 | B2 | 1/2008 | Rytlewski et al. | |
| 8,291,982 | B2 | 10/2012 | Murray et al. | |
| 8,342,245 | B2 | 1/2013 | Richard et al. | |
| 8,757,273 | B2 * | 6/2014 | Themig | E21B 43/26 166/373 |
| 9,359,877 | B2 | 6/2016 | Stout | |
| 9,416,643 | B2 | 8/2016 | Purkis et al. | |

(Continued)

FOREIGN PATENT DOCUMENTS

| | | |
|---|---|---|
| CA | 2838552 C | 5/2016 |
| WO | 2018187854 | 10/2018 |

*Primary Examiner* — Taras P Bemko
(74) *Attorney, Agent, or Firm* — Scott Richardson; Parker Justiss, P.C.

(57) ABSTRACT

Provided is a multi-functional well completion apparatus and method of operation thereof that offers the ability, in a single trip and with limited running tool manipulation, to perform a sand control frac or other fluid stimulation operation and reverse out operations that has improved reverse out flow rates. Furthermore, a combination of dropped balls and hydraulic pressure open one or more sleeves for selective access to a plurality of isolated zones. Additionally, a combination of concentric pipe and internal flow paths creates a reverse flow path. This reverse flow path provides a live annulus during treating, the ability to take returns, and the ability to reverse excess proppant from the wellbore.

37 Claims, 17 Drawing Sheets

(56) References Cited

U.S. PATENT DOCUMENTS

| | | | | |
|---|---|---|---|---|
| 10,280,718 | B2 * | 5/2019 | Broussard | E21B 33/1208 |
| 2008/0302538 | A1 | 12/2008 | Hofman | |
| 2013/0161017 | A1 | 6/2013 | King | |
| 2014/0190685 | A1 | 7/2014 | Frazier et al. | |
| 2014/0318816 | A1 | 10/2014 | Hofman et al. | |
| 2015/0136392 | A1 | 5/2015 | Jackson et al. | |
| 2018/0094508 | A1 | 4/2018 | Smith et al. | |

* cited by examiner

MULTI-FUNCTIONAL SLEEVE COMPLETION SYSTEM WITH RETURN AND REVERSE FLUID PATH

CROSS-REFERENCE TO RELATED APPLICATION

This application claims the benefit of U.S. Provisional Application Ser. No. 62/727,774, filed on Sep. 6, 2018, entitled "PIN-POINT STIMULATION SYSTEM WITH RETURN AND REVERSE FLUID PATH," commonly assigned with this application and incorporated herein by reference in its entirety.

BACKGROUND

Gravel pack assemblies and frac pack assemblies are commonly used in oil field well completions. A frac pack assembly is used to stimulate well production by using liquid under high pressure pumped down a well to fracture the reservoir rock adjacent to the wellbore. Propping agents suspended in the high-pressure fluids (in hydraulic fracturing) are used to keep the fractures open, thus facilitating increased flow rates into the wellbore. Gravel pack completions are commonly used for unconsolidated reservoirs for sand control. Gravel packs can be used in open-hole completions or inside-casing applications. An example of a typical gravel pack application involves reaming out a cavity in the reservoir and then filling the well with sorted, loose sand (referred to in the industry as gravel). This gravel pack provides a packed sand layer in the wellbore and next to the surrounding reservoir producing formation, thus restricting formation sand migration. A slotted or screen liner is often run in the gravel pack which allows the production fluids to enter the production tubing while filtering out the surrounding gravel. However, though these gravel pack assemblies work well, they require a number of trips into the well to install the completion tools and perform operations, which translates into increased risk, time, and costs.

Therefore, what is needed in the art is a multi-zone pack assembly that can be remotely activated without the necessity of physically raising and lowering the work string and crossover tool to each zone of interest.

BRIEF DESCRIPTION

Reference is now made to the following descriptions taken in conjunction with the accompanying drawings, in which.

DETAILED DESCRIPTION

Figure 1:
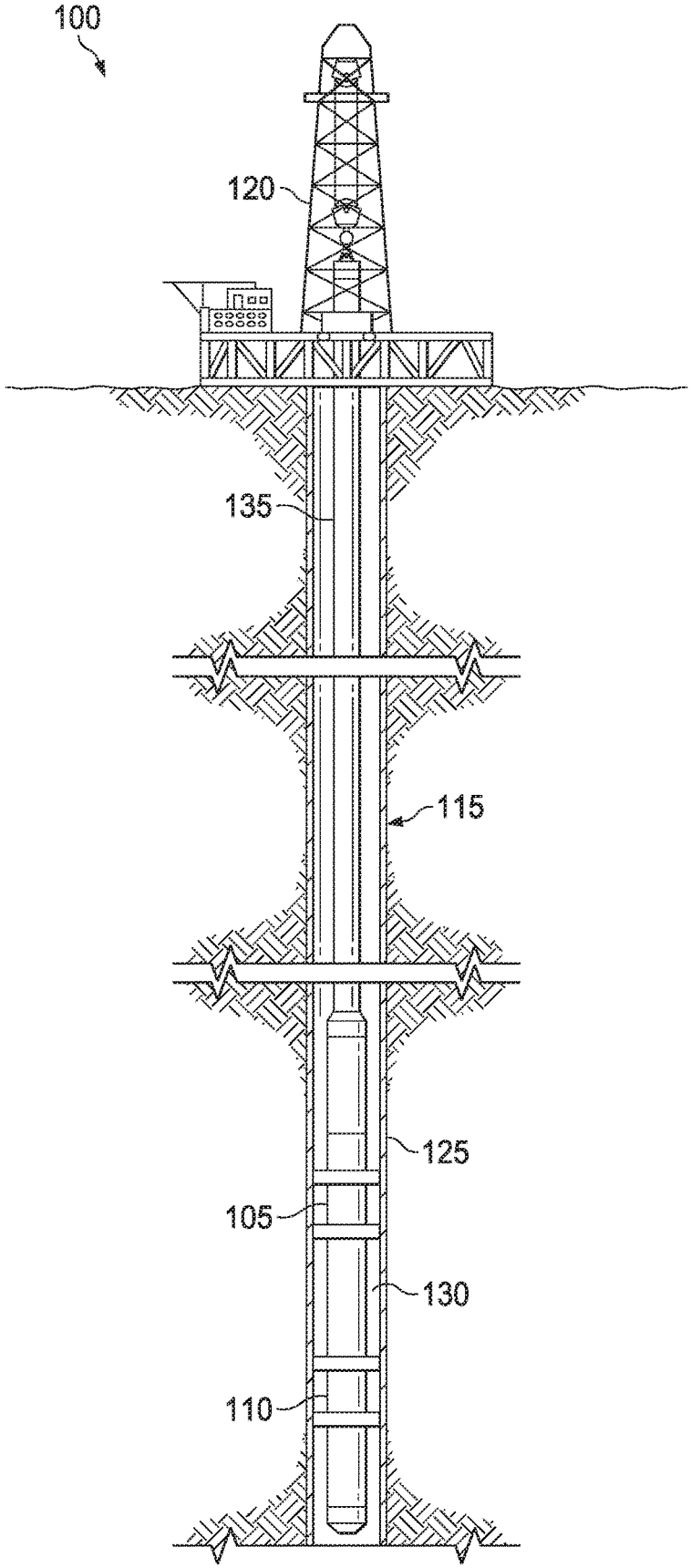
FIG. 1 illustrates an embodiment of a well completion system designed and manufactured according to the disclosure.

Provided is a multi-functional well completion apparatus and method of operation thereof that offers the ability, in a single trip and with limited running tool manipulation, to perform a sand control frac or other fluid stimulation operation and reverse out operations that has improved reverse out flow rates. Furthermore, a combination of dropped balls and hydraulic pressure open one or more sleeves for selective access to a plurality of isolated zones. Additionally, a combination of concentric pipe and internal flow paths creates a reverse flow path. This reverse flow path provides a live annulus during treating, the ability to take returns, and the ability to reverse excess proppant from the wellbore.

Further, as disclosed therein, embodiments of the multi-functional well completion apparatus provides internal fracking and reverse out flow paths that can be fluidly connected to an internal longitudinal flow path by operation of different sleeves located within the multi-functional well completion apparatus, which offer advantages over known designs. For example, embodiments of the multi-functional well completion apparatus provides an apparatus that can be easily connected to uphole, lower completion, and adapter tubes at the drilling site with minimal assembly effort that can be used with a known running tool to provide a higher reverse out fracking proppant rate than known systems, while providing a compact design with internal flow paths. This is in contrast to certain known systems that have multiple small external tubes and control lines that extend through feed through packers. Due to the size limitations of these small external tubes, the reverse out rate typically occurs at a low flow rate, which results in increased rig time and costs. Further, the external tubes are constantly exposed to significant frictional forces associated with fracking proppant movement that exposes them to increased wear, thereby reducing its operational life.

It is known that to reverse out proppants, such as fracking sand, efficiently, a certain velocity, and flow area is required. The embodiments of the multi-functional well completion apparatus as provided by this disclosure not only limits the amount of friction on external components, but it also provides a system that allows for improved cleanout rates and reverse out flow rates. Further, the multiple multi-functional well completion apparatus can be connected together in sequence within the wellbore and sequentially activated by dropping sealing balls into the multi-functional well completion apparatus. As discussed below, some embodiments provide a structure that allows the same size ball to be used, while other embodiments provide for sequential balls with increasing diameters be used to activate each multi-functional well completion apparatus from downhole to uphole locations.

While fracking, the net pressure gain can be monitored and returns can be taken to dehydrate the slurry and induce a pack and screen out. In one embodiment that allows the same size sealing balls to be used, after a screen out is achieved, applied annulus pressure deploys a ball seat on the next zone up and opens the production sleeve of the zone just fracked. Increased pressure on the annulus may close the frac sleeve and open a communication path to reverse excess slurry from the system ID. After completing the reverse out, a ball can be forward circulated down to an uphole zone, landing on the newly deployed or fixed ball seat. Pressure applied against the ball on the seat shifts a frac sleeve open while simultaneously shutting off communication to the reverse path below. This process could be repeated for any number of remaining zones until all the zones are stimulated. Thus, a device according to the disclosure is able to stimulate, provide sand control, and reverse out excess proppant from a multi zone well without manipulating a service tool between zones.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

Unless otherwise specified, any use of any form of the terms "connect," "engage," "couple," "attach," or any other term describing an interaction between elements includes not only direct connection, unless specified, but indirect connection or interaction between the elements described, as well. As used herein and in the claims, the phrase "configured" means that the recited elements are connected either directly or indirectly in a manner that allows the stated function to be accomplished. These terms also include the requisite physical structure(s) that is/are necessary to accomplish the stated function.

In the following discussion and in the claims, the terms "including" and "comprising" are used in an open-ended fashion, and thus should be interpreted to mean "including, but not limited to." Further, references to up or down are made for purposes of description purposes only and are not intended to limit the scope of the claimed embodiments in any way, with "up," "upper," or "uphole," meaning toward the surface of the wellbore and with "down," "lower," "downward," "downhole," or "downstream" meaning toward the terminal end of the well, as the multi-functional well completion assembly would be positioned within the wellbore, regardless of the wellbore's orientation. Further, any references to "first," "second," etc. do not specify a preferred order of method or importance, unless otherwise specifically stated, but such terms are for identification purposes only and are intended to distinguish one element from another. For example, a first element could be termed a second element, and, similarly, a second element could be termed a first element, without departing from the scope of the embodiments of this disclosure. Moreover, a first element and second element may be implemented by a single element able to provide the necessary functionality of separate first and second elements. The terms "longitudinal" and "lateral" are used herein and in the claims with regard to certain fluid paths. However, these terms are meant to indicate a general direction only, which is generally along a longitudinal axis even though it is not parallel with the longitudinal axis or generally along a lateral axis even though it is not perpendicular to the longitudinal axis.

FIG. 1. Illustrates a well completion system 100 in which one or more of the embodiments of the multi-functional well completion apparatus 105, 110, according to this disclosure, may be implemented. FIG. 1 illustrates two multi-functional well completion apparatus 105, 110, positioned in a wellbore 115 and across from a zone of interest, such as a geological formation that may contain oil or gas, which is hereinafter referred to as a "zone." Though only two multi-functional well completion assemblies are illustrated, it should be understood that more than two multi-functional well completion assemblies may be placed in the wellbore with each being placed across from a zone. As discussed below, the multi-functional well completion assemblies 105, 110 may be operated sequentially. For example, once the lower zone is stimulated, the next zone, uphole from the lower zone may be stimulated, until all of the zones are stimulated, all of which may be accomplished without the need for multiple trips into and out of the wellbore 115 or moving the string of tubing 135 considerably. The well completion system 100 includes a conventional rig 120, which may be a sea drilling platform or a land platform or work-over rig. At this stage of the drilling operations, a casing 125 has been inserted into the wellbore 115 and cemented into place, which forms a well annulus 130. However, the embodiments according to this disclosure may be used in open hole operations, as well. By way of convention in the following discussion, though FIG. 1 depicts a vertical wellbore, it should be understood by those skilled in the art that embodiments of the apparatus according to the present disclosure are equally well suited for use in wellbores having other orientations including horizontal wellbores, slanted wellbores, multilateral wellbores or the like. Additionally, though a drilling rig 105 is shown, those skilled in the art understand that a work-over rig or truck equipped with a coil tubing or wire line may also be used to operate the embodiments of the apparatus according to the present disclosure. The drilling rig 120 supports a string of tubing 135, which is coupled to the multi-functional well completion assemblies 105, 110 by way of a lower completion assembly, the details of which are shown and discussed below.

Figure 2:
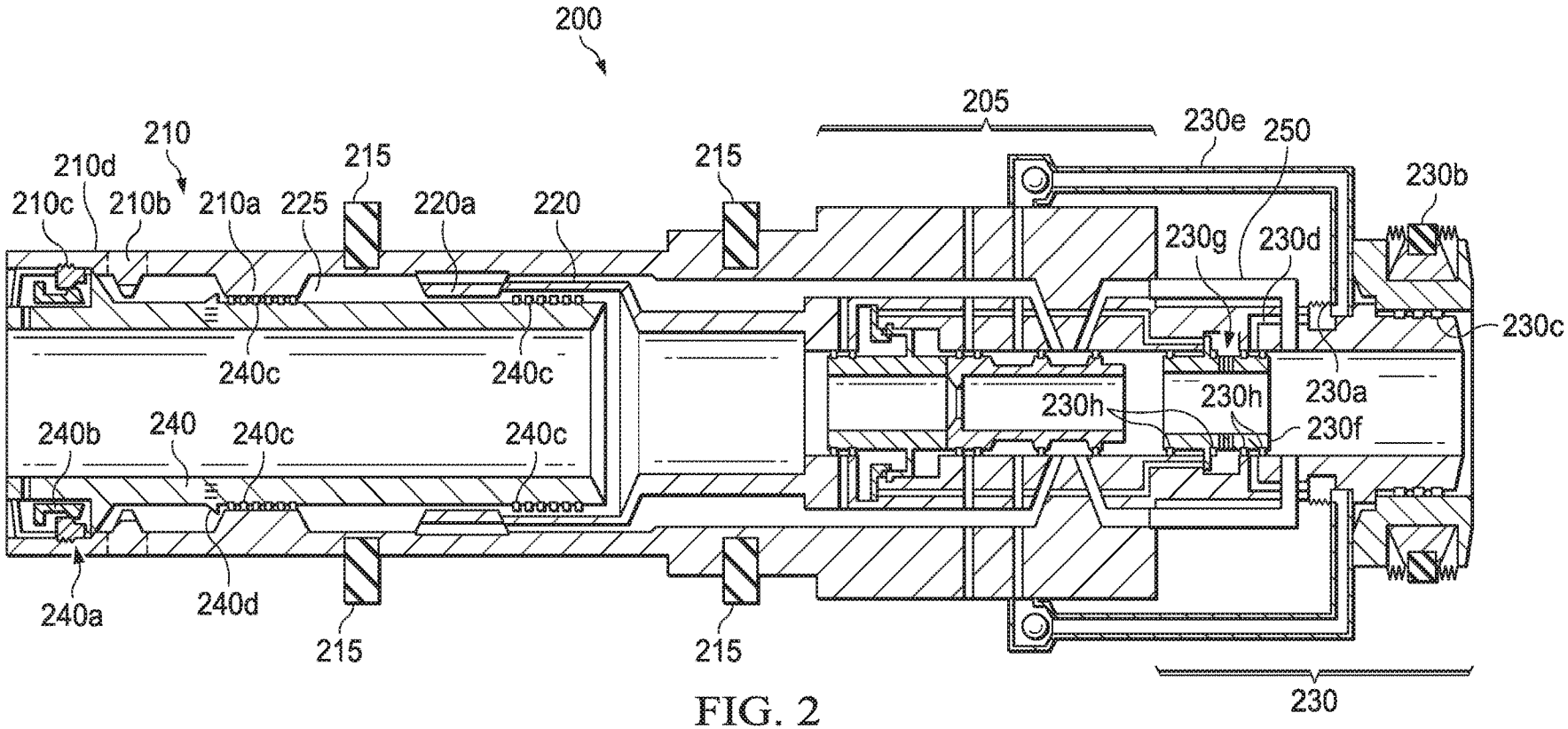
FIG. 2 illustrates a sectional view of one embodiment of a well completion assembly, as provided by this disclosure.

FIG. 2 illustrates a sectional view of one embodiment of a singular well completion assembly 200 that includes an embodiment of a multi-functional well completion assembly 205 according to this disclosure. Though only one well completion assembly 200 is shown, as discussed below, the well completion assembly 200 may include multiple multi-functional well completion assemblies 205, each positioned across a respective zone, as generally shown in FIG. 1. In addition to the multi-functional well completion assembly 205, the well completion assembly 200 includes a lower completion device 210 that is coupled, for example, by corresponding threads, to an uphole end of the multi-functional well completion assembly 205. In one embodiment, the lower completion device 210 includes one or more packers 215 that are used to set the well completion assembly 200 in the wellbore and isolate the zone. The packers 215 are deployed to isolate each zone within the well bore. The packers 215 may be hydraulic packers or swellable packers that may be deployed using fluid pressure. For example, the packers 215 may be set, in one embodiment, by applying fluid pressure through the tubing string against the packers 215 (e.g., in some embodiments using a reverse path of the well completion assembly 200). The uphole packer devices 215 are configured, in this embodiment, to be deployed at the same time, however, in other embodiments that include multiple well completion assemblies 200, the packer devices 215 may be separately deployed or simultaneously deployed. Those skilled in the art would understand what modifications would be necessary to achieve this separate and independent deployment scheme. When deployed, the uphole packer devices 215 extend radially outward against the wellbore. Because of the unique configuration of the embodiments of the multi-functional well completion assembly 205, according to this disclosure, feed through packers, which are associated with certain known devices, are not needed. Thus, the complexity of the packer system is simplified, resulting in decreased assembly and rig time and overall cost reduction. The lower completion device 210 may include, a seal bore 210*a*, an indicator coupling 210*b*, and a coupling mechanism 210*c* located in a landing head section 210*d*, whose purposes are discussed below.

Also coupled to the uphole end of the multi-functional well completion assembly 205 is an adapter tube 220 that, in one embodiment, has a flared uphole end that includes a seal bore 220*a*. The adapter tube 220 and the lower completion device 210 cooperate to form a concentric flow path 225 between the outer diameter of the adapter tube 220 and inner diameter of the lower completion device 210. When multiple multi-functional well completion assemblies 205 are used, the lower completion device 210 and the adapter tube 220 are coupled to the upper most multi-functional well completion assembly 205 in the sequential string.

A production and screen assembly 230 may be coupled to a downhole end of the multi-functional well completion assembly 205. In the illustrated embodiment, the production and screen assembly 230 include a production screen 230*a*, a sump packer 230*b*, such as a sump packer, having seals 230*c* and a production port 230*d* associated therewith. However, other embodiments may exist wherein no downhole packer 230*b* is used, and a bullnose, float shoe, or another isolation method could be used. In yet another embodiment, the lower completion device 210 has an integrated downhole packer device, which creates the aforementioned isolation. The production and screen assembly also includes a dehydration or leak off tube 230*e*, and a production sleeve 230*f* having production openings 230*g* and seals 230*h* associated therewith, and a reverse flow path conduit 250 whose purposes are discussed in more detail below. The lower completion device 210 and the adapter tube 220 each have inner diameters that are designed to receive a running tool 240 therein, as shown in the illustrated embodiment. The running tool 240 may be used to position the well completion assembly 200 at a particular location within a zone of interest and can be removably coupled to the uphole end of the lower completion device 210 by any known coupling mechanism 240*a* that cooperatively engages the coupling mechanism 210*c* of the lower completion device 210 and that allows the components to be easily decoupled from each other using standard downhole operations. For example, the latch mechanism 240*a* of the running tool 240 may include a plurality of teeth and an activation sleeve 240*b* that may engage a corresponding profile in the lower completion device 210. The running tool 240 also includes one or more seal elements 240*c* that cooperate with seal bore 210*a* of the lower completion device 210 and the seal bore 220*a* of the adapter tube 220, when the running tool 240 is lifted uphole within the lower completion device 210. The running tool also includes a locator collet 240*d*. Both the coupling mechanism 210*c* and the coupling mechanism 240*a* may be of known design. For example, the latch mechanisms 210*c* and 240*a* may be cooperating latching teeth located on each of the devices, as shown in FIG. 2 that allow the lower completion device 210 to be easily released from the running tool 240.

Figure 3A:
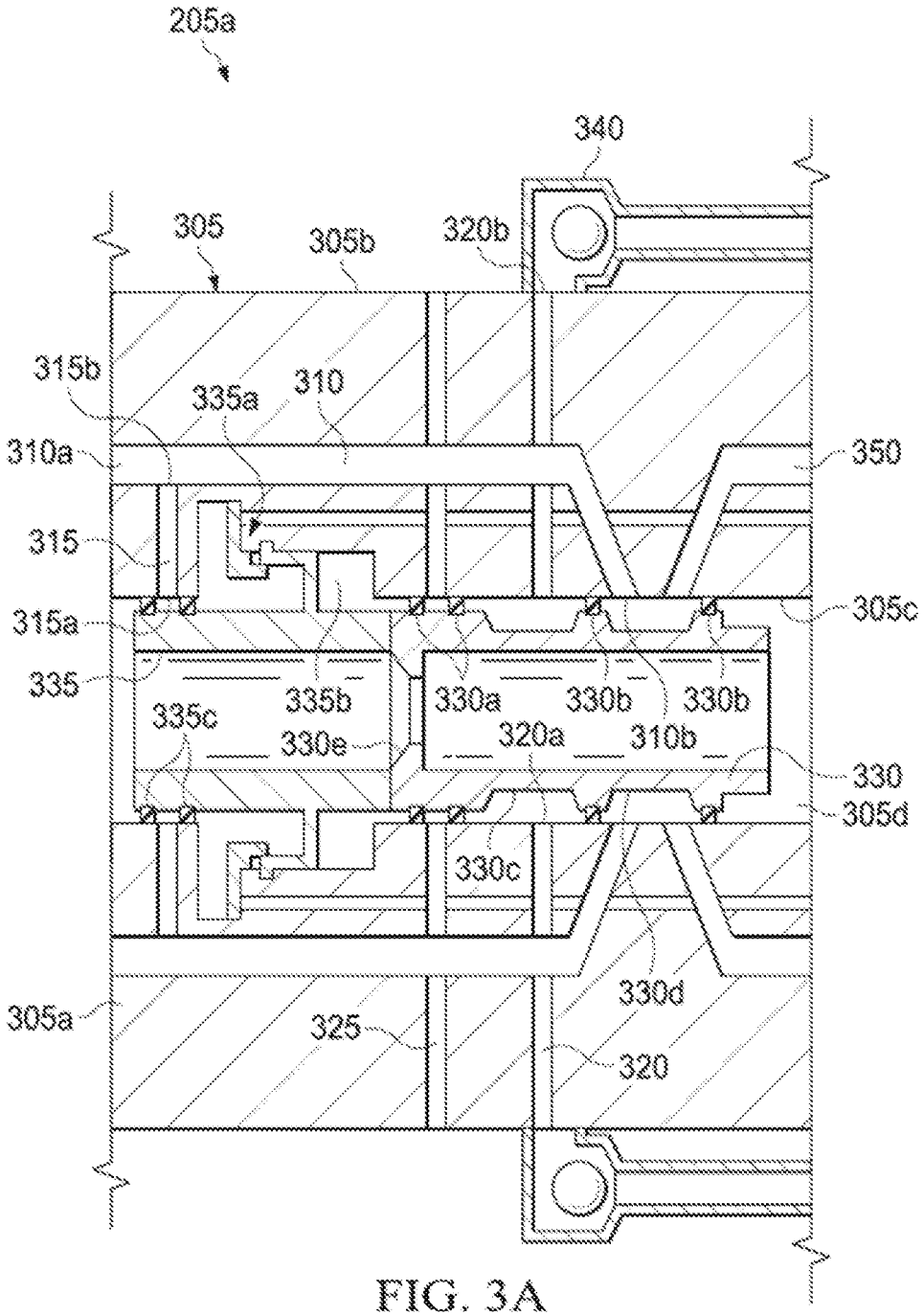
FIG. 3A illustrates one embodiment of a multi-functional well completion assembly according to the disclosure.
Figure 3B:
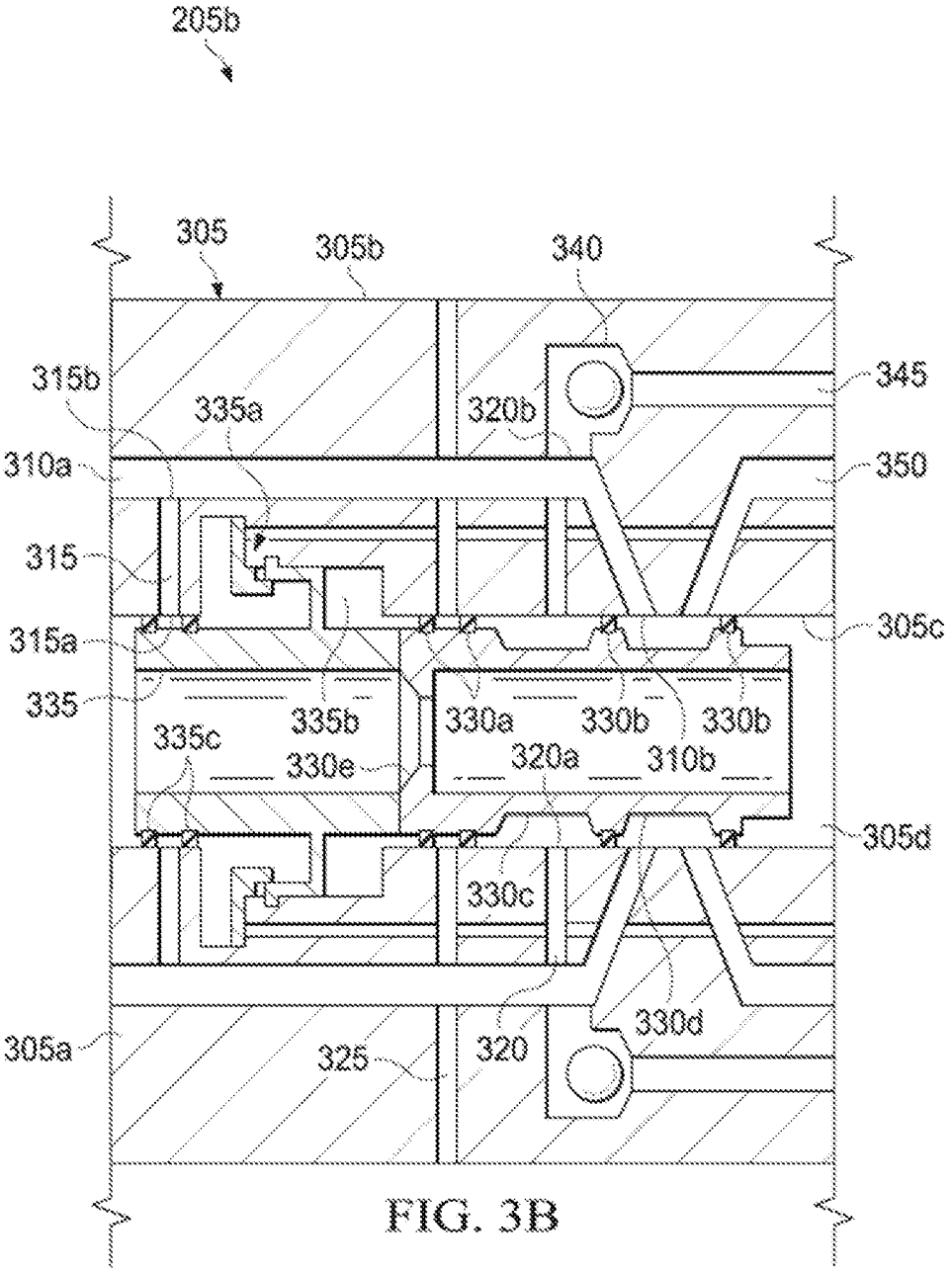
FIG. 3B illustrates another embodiment of a multi-functional well completion assembly according to the disclosure.

FIGS. 3A and 3B illustrate cross-section views of two different embodiments 205a and 205b of the multi-functional well completion assembly 205. It should be noted in the figures that follow, that these two embodiments will be used interchangeably. The illustrated embodiments commonly comprise a tubular member 305 that has a wall 305*a*, an outer diameter (OD) 305*b*, and an inner diameter (ID) 305*c*, and a central bore 305*d* extending there through and defined by the ID 305*c*. The uphole end (left side of FIGS. 3A and 3B) and the downhole end (right side of FIGS. 3A and 3B) tubular member 305 may have internal threads in their respective ends that can be used to couple the tubular member 305 to other lower completion tools with cooperating threads. The central bore 305*d* forms a central fluid path into and out of the tubular member 305 that can be used in moving fluid through the tubular member 305 in both uphole and downhole directions. A longitudinal fluid path 310 is located within the wall 305*a* and has a first end 310*a* that opens at an uphole end of the tubular member 305 and a second end 310*b* that opens into the central bore 305*d*, as shown. A first lateral fluid path 315 is also located within the wall 305*a* and has a first end 315*a* that opens into the central bore 305*d* and a second end 315*b* that opens into the longitudinal fluid path 310 and cooperates with the longitudinal fluid path 310 to provide a reverse out fluid path. A second lateral fluid path 320 is located within the wall 305*a* and has a first end 320*a* that opens into the central bore 305*d* and a second end 320*b* that either extends to the OD 305*b* or terminates within the wall 305*a*, and a lateral frac fluid path 325 that extends from the central bore 305*d* to the OD 305*b*. As shown in the illustrated embodiments, neither the second lateral fluid path 320 nor the lateral frac fluid path 325 intersect the longitudinal fluid path 310. Also, though the cross section shows the different fluid paths on opposing sides of the tubular member 305, it should be understood that multiples of the fluid paths mentioned above could be located about the central bore 305*d* of the tubular member 305 and within the wall 305*a*.

The multi-functional well completion assembly 205 also includes a frac sleeve 330 slidably engaged within the central bore 305*d* and has a set of spaced apart seal elements 330*a*, 330*b* associated therewith that sealingly engage the ID 305*c* of the tubular member 305, as shown in the embodiments of FIGS. 3A and 3B. One or more annular grooves 330*c*, 330*d* are located between the seal element 330*a*, 330*b*, which form fluid connection spaces for the fluid paths, depending on the frac sleeve's 330 position, as discussed herein. In one embodiment, the frac sleeve 330 includes a ball seat 330*e* located on an uphole end of the frac sleeve, as shown in FIGS. 3A and 3B. In this embodiment, the ball seat 330*e* is fixed and forms a portion of the frac sleeve 330. The ball seat 330*e* extends radially inward by a distance (x) from the frac sleeve 330. In the particular embodiment shown, the ball seat 330*e* is a tapered feature. The term "tapered", as that term is used with regard to the ball seat 330*e*, means that sequentially uphole ball seat 330*e* taper radially inward by a lesser amount than the next downhole feature. Thus, sequentially larger drop balls could be used to sequentially activate the next uphole zone. However, in other embodiments, as explained below, the ball seat 330*e* may be a baffle ball seat that can be selectively deployed.

When positioned over the fluid paths, which have an end that terminates at the ID 305*c*, the annular grooves 330*c*, 330*d* form a fluid space between the annular grooves 330*c* or 330*d*, and the ID 305*c* of the tubular member 305. As discussed below, the frac sleeve 330 is slidable to a frac position within the central bore 305*d* to establish a fracking fluid path from the central bore 305*d* to a wellbore annulus (FIG. 1). As discussed and shown in more detail below, while in the frac position, the frac sleeve 330 also fluidly connects the second lateral fluid path 320 with the longitudinal fluid path 310 by way of the fluid space between the annular groove 330*c*. The multi-functional well completion assembly 205 also includes a reverse sleeve 335 that is slidably engaged within the central bore 305*d*. In one embodiment, the reverse sleeve 335 may be activated by way of a valve mechanism 335*a*, such as a pressure activated piston, that is located within a chamber 335*b* that is formed in the wall 305*a* of the tubular member 305. The reverse sleeve 335, also has a set of seal elements 335*c* associated therewith that sealingly engages the ID 305*c* of the tubular member 305 and that is slidable to a reverse out position within the central bore 305*d* to establish a fluid path between the central bore 305*d* and the longitudinal fluid path 310 by way of the first lateral fluid path 315.

In another embodiment, the multi-functional well completion assembly 205 further comprises a flow restrictor 340 that may be coupled to the tubular member 305 in different ways, depending on the embodiment. The flow restrictor 340 might comprise a relief valve, a poppet valve, or another similar restrictor and remain within the scope of the disclosure. The flow restrictor 340 is coupled to the second end 320*b* of the second lateral fluid path 320, that can be fluidly connectable to a zone of a wellbore and the longitudinal fluid path 310 when the frac sleeve 330 is in the frac position. The fluid path extends through the wall 305*a* of the tubular member 305 by way of the second lateral fluid path 320 and to the longitudinal fluid path 310. The annular groove 330*c* and the ID 305*c* of the tubular member 305 fluidly connect the second lateral fluid path 320 and the longitudinal fluid path 310. However, it should be understood that the fluid path does not enter the central portion of the central bore 305*d*, but is confined to near the ID 305*c* and within one of the annular grooves 330*c*, 330*d* of the frac sleeve 330 and by the appropriate set of seal elements 330*a*, 330*b* as explained in more detail below. In the embodiment of FIG. 3A, the second lateral fluid path 320 extends to the OD 305*b* of the tubular member 305 and the flow restrictor 340 is externally coupled to the OD 305*b* of the tubular member 305 at the second end 320*b* of the second lateral fluid path 320. Any known type of coupling may be utilized, such as cooperating thread patterns and other known coupling devices and mechanisms. However, in the embodiment of FIG. 3B, the flow restrictor 340 is located within the wall 305*a* and the second end 320*b* of the second lateral fluid path 320 opens into the flow restrictor 340 to form a fluid path from the flow restrictor 340 to the ID 305*d*. This embodiment further includes a leak off port 345 that extends from the flow restrictor to the downhole end of the tubular member 305. The leak-off port 345 can be connected to a dehydration tube (not shown). Known manufacturing processes may be used to form the flow restrictor 340 and associated fluid paths within the wall 305*a*. The flow restrictor 340 may function as a non-restrictor when the fluid flows uphole, or as a check valve or restrictor when the fluid flows downhole. In alternative embodiments, the longitudinal fluid path 310 is a first longitudinal fluid path and the multi-functional well completion assembly 205 further comprises a second longitudinal fluid path 350 located within the wall 305*a* of the tubular member 305 that extends from ID 305*c* of the tubular member 305 to a downhole end of the tubular member 305, as shown in the illustrated embodiments. When the frac sleeve 330 is not in the frac position, the first and second longitudinal fluid paths 310 and 350 are fluidly connected by the annular groove 330*d* and seal elements 330*a*, 330*b* and are disconnected when the frac sleeve 330 is in the frac position.

Figure 4:
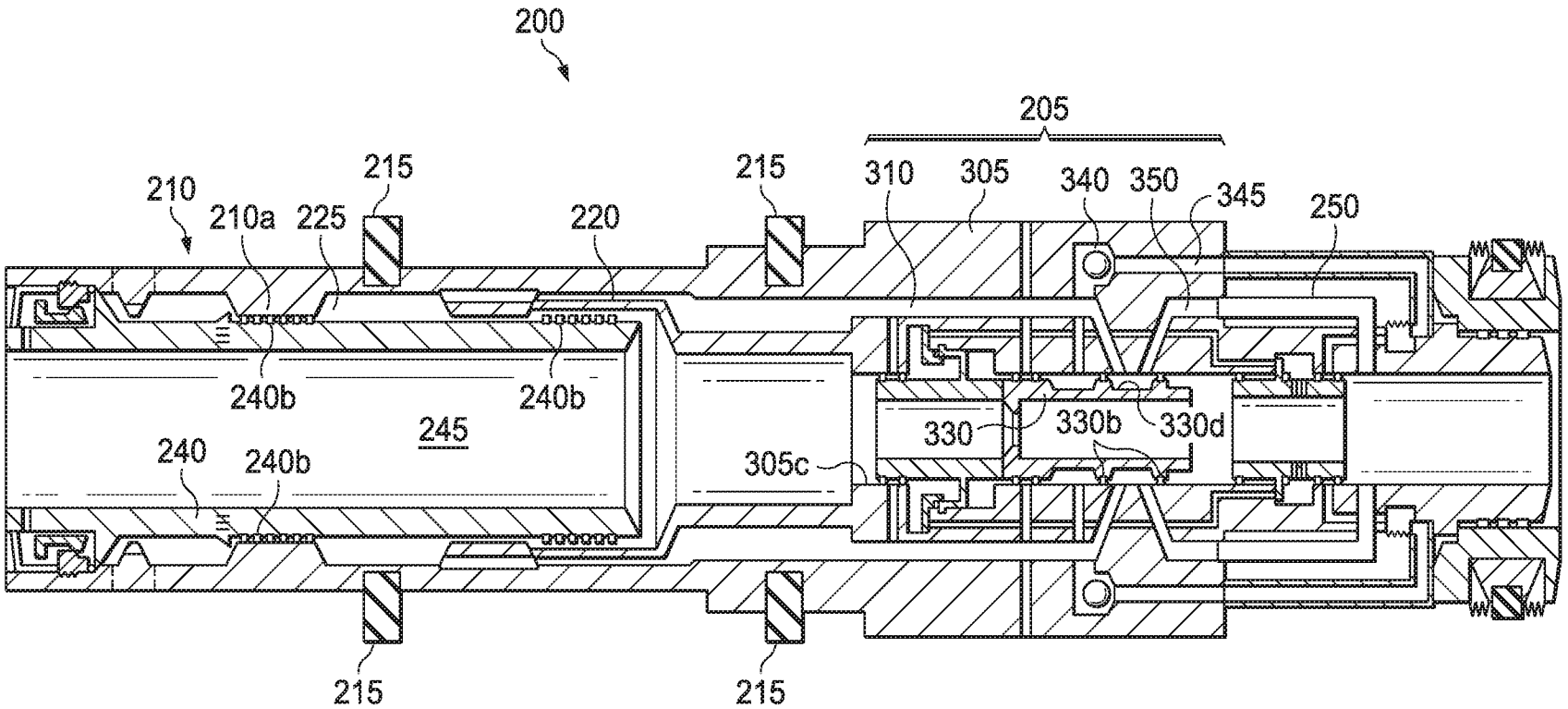
FIG. 4 illustrates an embodiment of the well completion assembly as provided by this disclosure, where the components are positioned to set isolation packers.

FIG. 4 illustrates an embodiment of the well completion assembly 200 where the components are positioned to set the packers 215, for example with the running tool 240 received within the lower completion device 210 and the adapter tube 220, as generally shown. As mentioned above, the packers 215 do not have to be feed through packers, as required by other known systems, since the multi-functional well completion assembly 205 of this disclosure does not require external tubes and control lines that pass through packers to accomplish circulation flow. Though the illustrated embodiment shows the flow restrictor 340 internally located within the wall, the multi-functional well completion assembly 205 includes those embodiments where the flow restrictor 340 is coupled externally to the multi-functional well completion assembly 205, as discussed above. In this phase of operation, pressure is applied to a fluid, located within central bore 245 of the well completion assembly 200 and the running tool 240. Due to one set of the seals 240*b* of the running tool 240 being engaged against the seal bore 210*a* of the lower completion device 210, the setting pressure traverses the concentric flow path 225 and through the longitudinal fluid path 310. At this stage of operation, the frac sleeve 330 has not been shifted to the frac position. As a result, the setting pressure passes from the longitudinal fluid path 310, into the sealed space formed by the ID 305*c* of tubular member 305 and the annular groove 330*d* of the frac sleeve 330 that are located between seal elements 330*b*, into the second longitudinal flow path 350, and downhole through reverse flow path conduit 250, which connects the second longitudinal flow path 350 to the longitudinal flow path 310 in the zone below that forms a reverse flow path In the lowermost zone, this connection is not required, but it will be connected to the central bore 245 to allow the first setting ball to be circulated onto its seat. Once the ball lands and the sleeve shifts, the connection to the system ID 305*c* is shut off, as explained below. The pressurized setting fluid deploys the packers 215, which not only anchors the well completion assembly 200 against the walls of the wellbore, but also isolates the zone from uphole formations. The sump packer 230*b* would also be set prior to this time, which isolates the zone from any geological formations downhole of the well completion assembly 200. Thus, the packers 215 and sump packer 230*b* isolate the multi-functional well completion assembly 205 for further operations.

Figure 5:
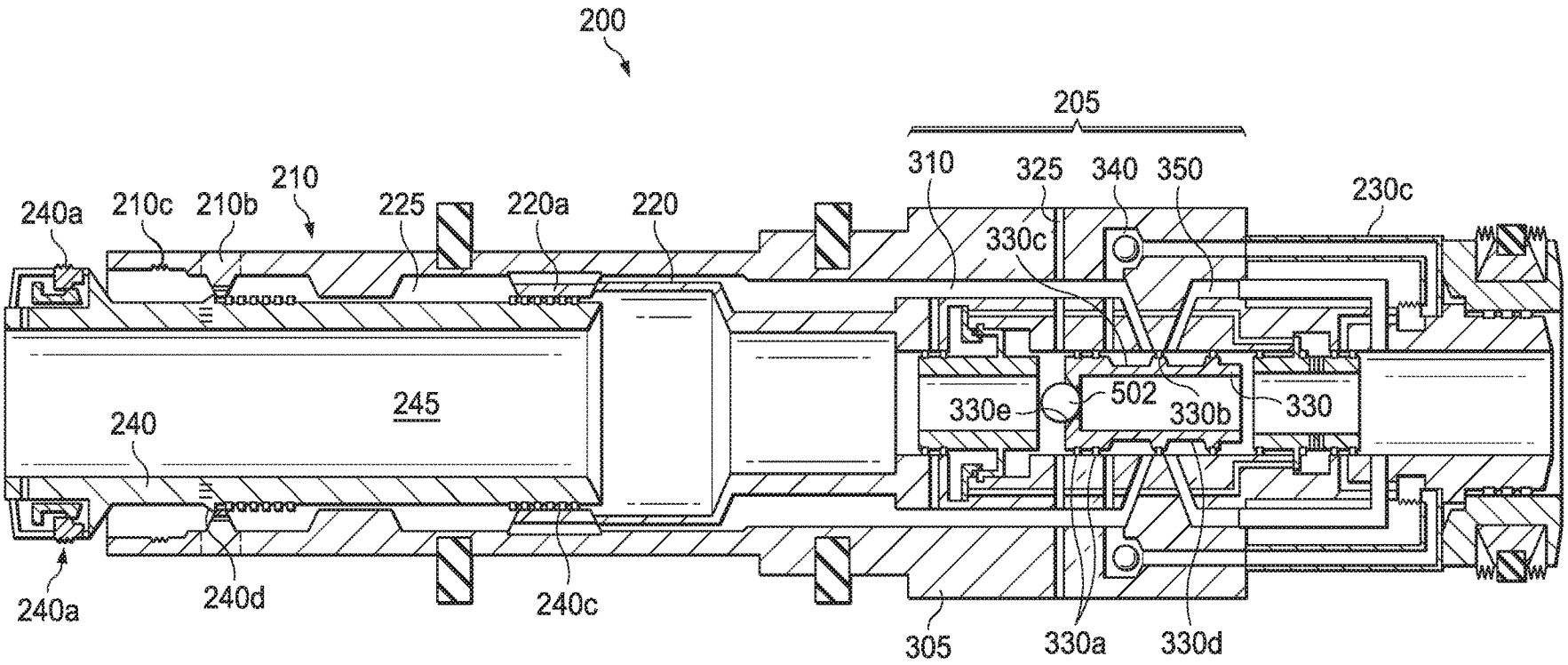
FIG. 5 illustrates the embodiment of FIG. 4 subsequent to shifting the frac sleeve to a frac position.

FIG. 5 illustrates the embodiment of FIG. 4 subsequent to shifting the frac sleeve 330 to a frac position. Prior to this operation, the corresponding coupling mechanism 210*c* of the lower completion device 210 is disengaged from the coupling mechanism 240*a* of the running tool 240, which allows the running tool to be pulled uphole, as shown. The running tool 240 is then set back down until a locator collet 240*d* of the running tool 240 engages the indicator coupling 210*b* of the lower completion device 210. Once the locator collet 240*d* is positioned on the indicator coupling 210*b*, the seal elements 240*c* of the running tool are sealing engaged against the seal bore 220*a* of the adapter tube 220. In this embodiment, the frac sleeve 330 is shifted by placing a sealing ball 502 on the ball seat 330*e* and pressuring up the fluid within the central bore 20 wellbore fluid, which causes the frac sleeve 330 to shift downhole, as shown. In the illustrated embodiment, the sealing ball 502 is placed by dropping the sealing ball 502 into the tubing string (not shown) and pumped downhole until it engages the ball seat 330*e*. When the sealing ball 502 is to be implemented in the first zone, the sealing ball 502 can be pumped down through the reverse flow path, as described above. For each subsequent zone, the sealing ball 502 may be circulated onto each respective ball seat through use of the first lateral fluid path 315 or reverse port. In this embodiment, the sealing ball 502 has a diameter that is larger than the diameter of the ball seat 330*e*, which prevents it from passing through the ball seat 330*e*, but that same diameter is designed to pass through any ball seats that might be located in uphole well completion assemblies 200, when multiple well completion assemblies 200 are present within the wellbore. Thus, when successive well completion assemblies 200 are strung together, each frac sleeve 330 will have a different ball seat diameter that gets increasingly larger going from downhole to uphole. This allows sealing balls of smaller diameter to pass through and be used for downhole fracking operation, and thus, provides a sequential completion system where each well completion assembly 200 can be activated as the production stimulation steps are moved uphole. The fluid pressure exerted against the sealing ball 502 causes the frac sleeve 330 to shift to a frac position and opens the lateral frac fluid path 325. At the same time, the frac sleeve is shifted to a position that fluidly connects the longitudinal fluid path 310 with the second lateral fluid path 320 by way of the annular groove 330*c* and seal elements 330*a*, 330*b*, while at the same time disconnecting the fluid path between the longitudinal fluid path 310 and the second longitudinal fluid path 350 by moving the annular groove 330*d* to a position where it no longer spans the ends of the longitudinal path 310 and the second longitudinal fluid path 350 as shown in the illustrated embodiment.

Figure 6:
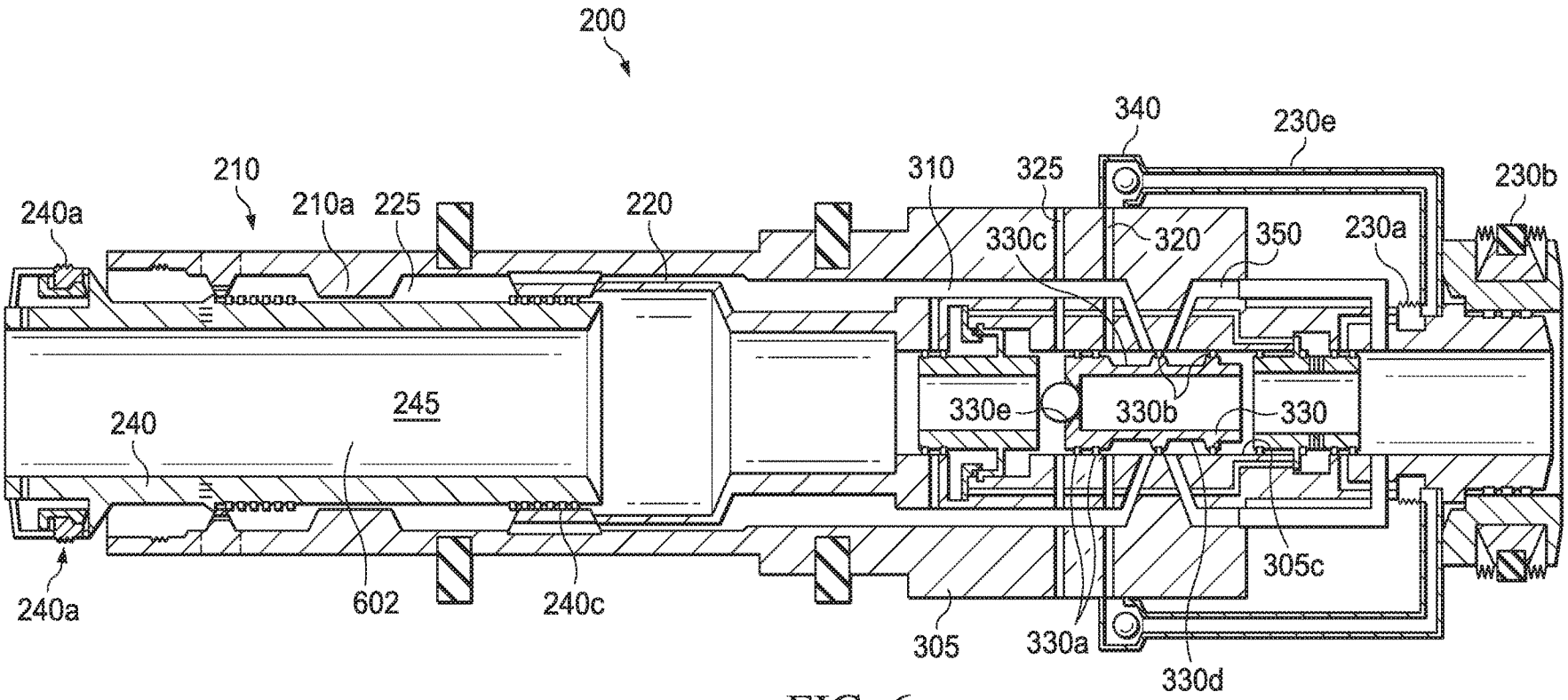
FIG. 6 illustrates an embodiment where the frac sleeve has been shifted downhole, which opens the lateral frac fluid path.

FIG. 6 illustrates an embodiment where the frac sleeve 330 has been shifted downhole, which opens the lateral frac fluid path 325, as discussed above. A frac fluid 602, is pumped downhole through the central bore 245 of the well completion device 200, under high pressure and through the lateral frac fluid path 325 into the annulus of a wellbore and the zone. The high pressure fractures the geological formation of the zone and props the fissures open for the production of fluids from the zone. While fracking, the net pressure gain can be monitored and returns can be taken to dehydrate the slurry and induce a pack and screen out. The screen 230*a* acts as a filter that produces a filtered frac fluid, which flows uphole through the dehydration tube 230*e* and through the flow restrictor 340, through the second lateral fluid path 320 and to the longitudinal flow path 310. Due to the direction of the fluid flow, the flow restrictor 340 permits flow through it. While in the frac position, the frac sleeve 330 fluidly connects the longitudinal fluid path 310 and the second lateral fluid path 320, while simultaneously disconnecting the longitudinal fluid path 310 from the second longitudinal flow that 350 by shifting annular groove 330*d* downhole such that is no longer fluidly connects the longitudinal flow path 310 and the second longitudinal flow path 350. The space between the annular groove 330*c* and the ID 305 of the tubular member 305 form a fluid path for the filtered fluid to flow from the second lateral fluid path 320 to the longitudinal fluid path 310, while the seal elements 330*a* and 330*b* form a fluid tight seal about the annular groove 330*c*. This configuration allows the filtered fluid to travel uphole through the longitudinal flow fluid path and into the concentric flow path 225. Because the running tool 240 has been lifted uphole, as previously explained, there is a flow space at the uphole end of the lower completion device 210 between it and the running tool 240, as shown. This allows the fluid to exit the concentric flow path 225 and then into the well annulus above the packers 215, as shown. This volume transition, which is provided by the embodiments of this disclosure, increases the flow path and allows for more efficient fluid return to the surface, thereby reducing rig time and associated costs.

Figure 7:
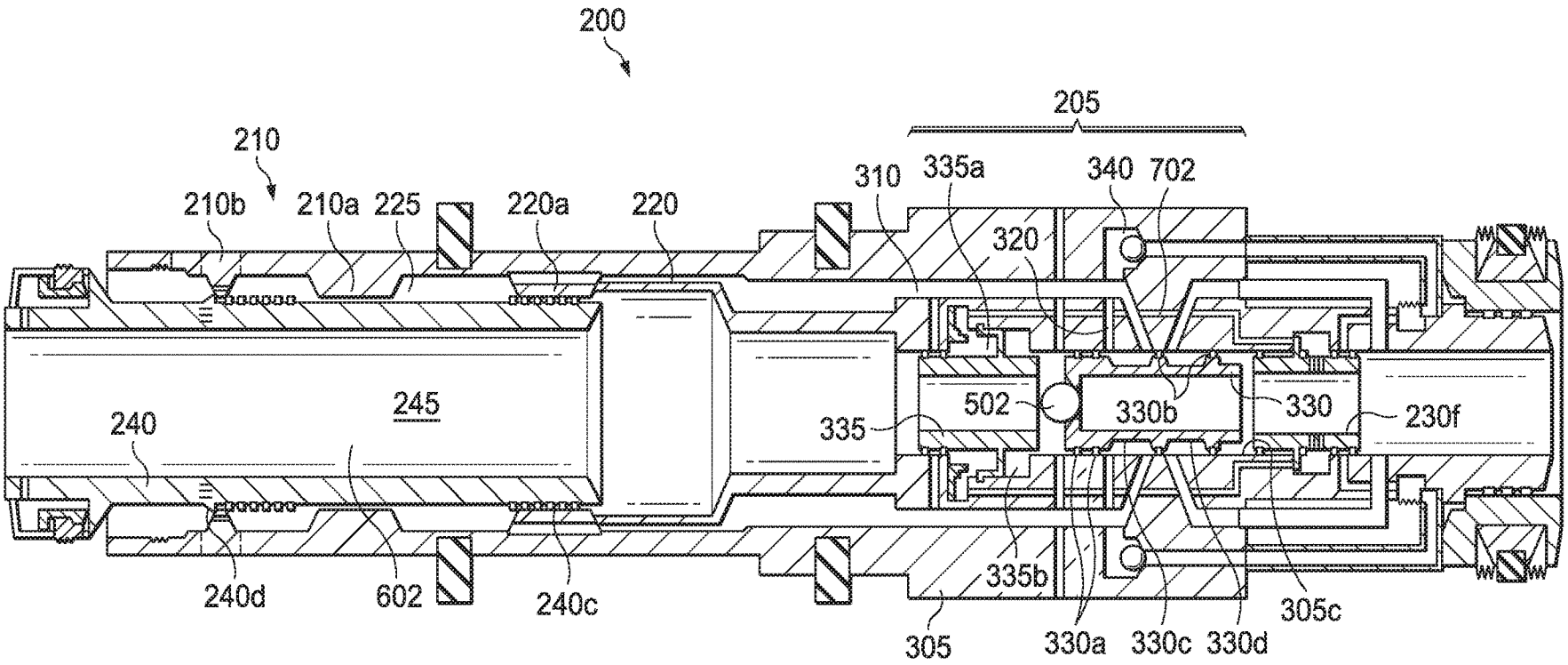
FIG. 7 illustrates an embodiment where, after the filtered fluid is returned, a reverse out fluid, is pumped down, the annulus of the wellbore and into the concentric flow path

In FIG. 7, after the filtered fluid is returned, a reverse out fluid is pumped down, the annulus of the wellbore and into the concentric flow path 225. At this stage of operation the position of the running tool 240 has not changed from the previous discussion, as the locator collet 240*d* is still in contact with the indicator coupling 210*b*. Thus, the seal elements 240*c* are also still engaged against the seal bore 220*a* of the adapter tube 220. As such, the pressure associated with the fluid passes through the concentric flow path 225 and into the longitudinal fluid path 310, and then into the second lateral fluid path 320 by way of the space formed by the annular groove 330*c* and the ID 305*c* of the tubular member 305, as indicated. The pressure traverses the second lateral fluid path 320 and into the flow restrictor 340. During this stage of operation, the flow restrictor 340 functions as a check valve by shutting off the fluid path beyond the flow restrictor 340, as shown. The pressure within the well completion assembly 200 is sufficient to activate the valve or piston mechanism 335*a* and force the reverse sleeve 335 downhole. The valve mechanism 335*a* is fluidly connected to the production sleeve 230*d* by way of a production sleeve activation port 702. The downhole movement of valve mechanism 335*a* causes a pressure to traverse the production sleeve activation port 702, which in turn shifts the reverse sleeve 335 and the production sleeve 230*f*.

Figure 8:
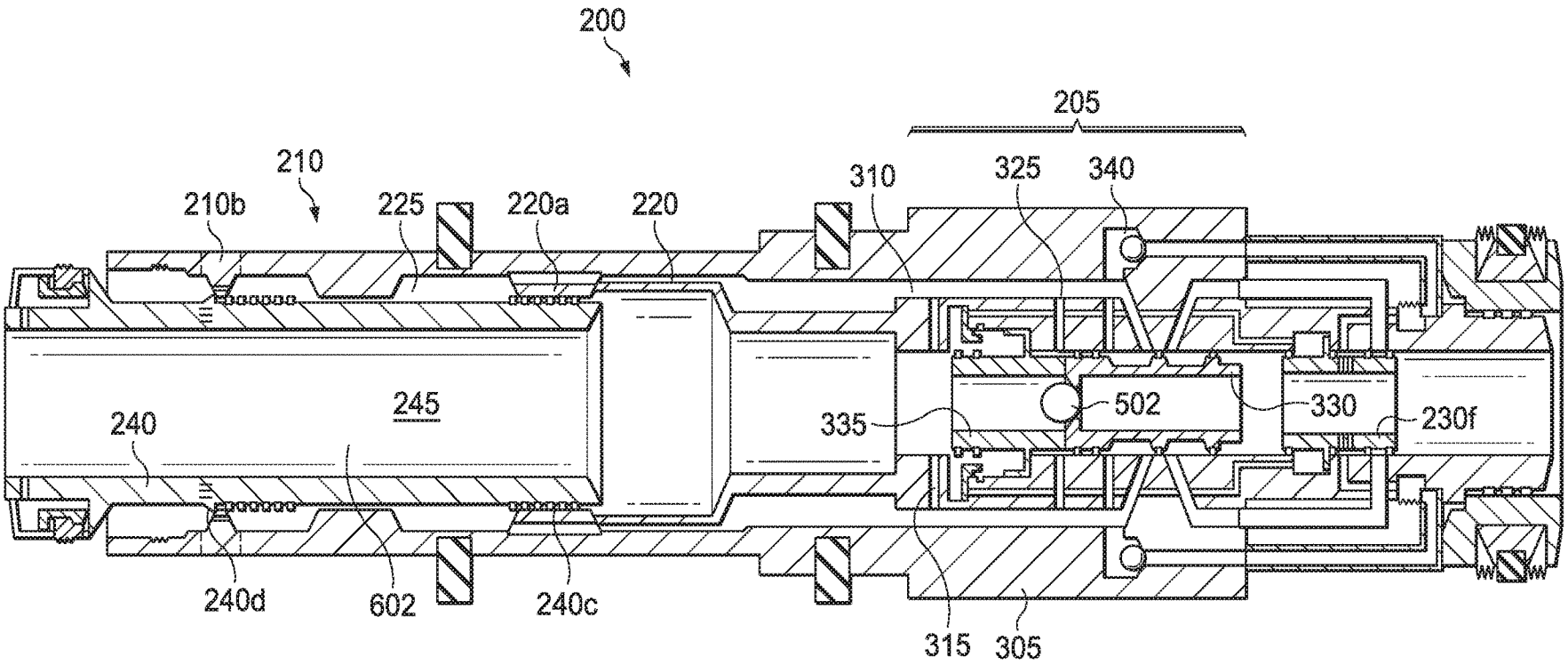
FIG. 8, illustrates the embodiments of FIG. 7, with the reverse sleeve shifted downhole and with the first lateral fluid path open, which allows reverse out of proppant from the central bore.

In FIG. 8, the downhole shift of the reverse sleeve 335 opens the first lateral fluid path 315 and closes the lateral frac fluid path 325, as shown. At this stage of operation the position of the running tool 240 has not changed from the previous discussion, as the locator collet 240*d* is still in contact with the indicator coupling 210*b*. Thus, the seal elements 240*c* are also still engaged against the seal bore 220*a* of the adapter tube 220, thereby maintaining the concentric flow path 225. The opening of the first lateral fluid path 315 allows the fluid to turn uphole, as the sealing ball 502 and flow restrictor 340 prevent fluid from passing downhole. The increase in circulation volume as provided by the concentric flow path 225 provides sufficient force to push the frac fluid 602 uphole, which remains in the central bore 245 of the well completion assembly 200, uphole.

Figure 9:
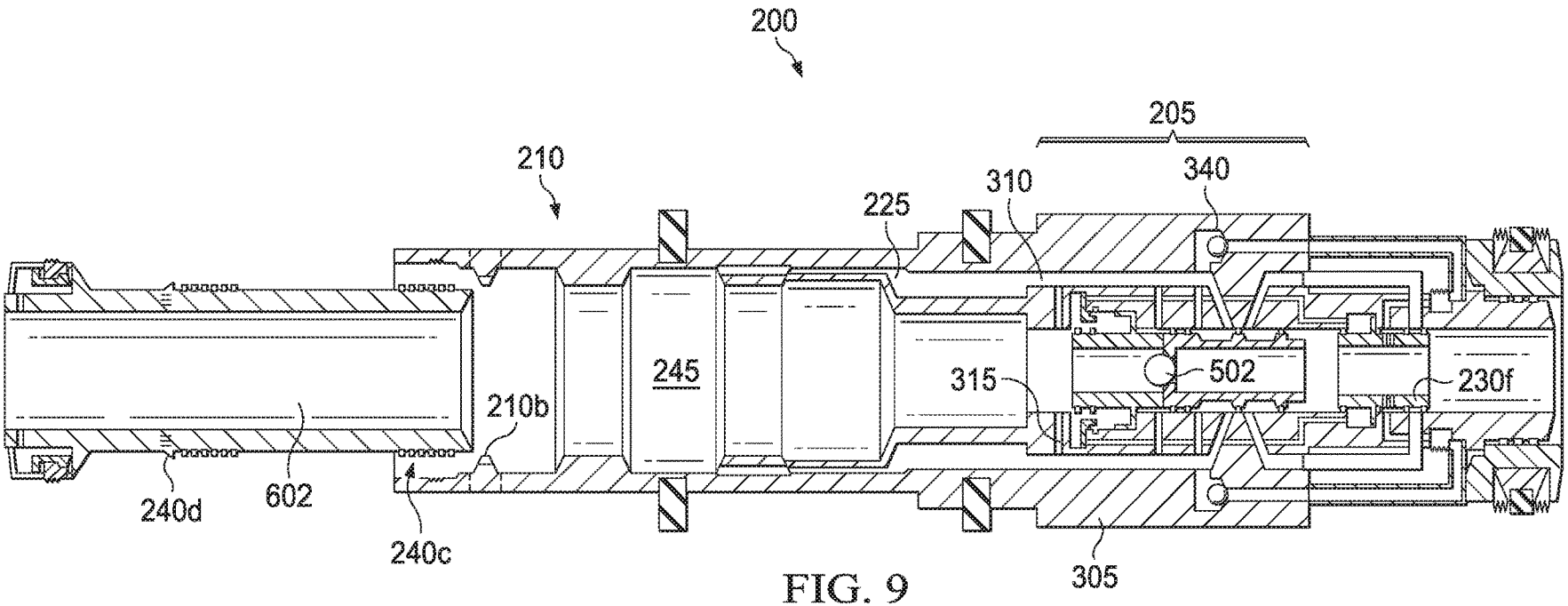
FIG. 9 illustrates the embodiment of FIG. 8, following the lift up of the running tool to increase volume within the device and thereby increase a flow rate of proppant from the central bore.

In FIG. 9, following the opening of the first lateral fluid path 315, the running tool 240 is lifted further uphole to where the seal elements 240*c* of the running tool 240 are just below the uphole end of the lower completion device 210. At this stage of operation, the first lateral fluid path 315 is still in the open position, providing fluid flow to the central wellbore 245 However, the uphole movement of the running tool 240 substantially opens up the volume of the central bore 245, and as such, provides significantly more flow rate that provides the pressure needed to efficiently remove the frac fluid 602 uphole and out of the wellbore.

Figure 10A:
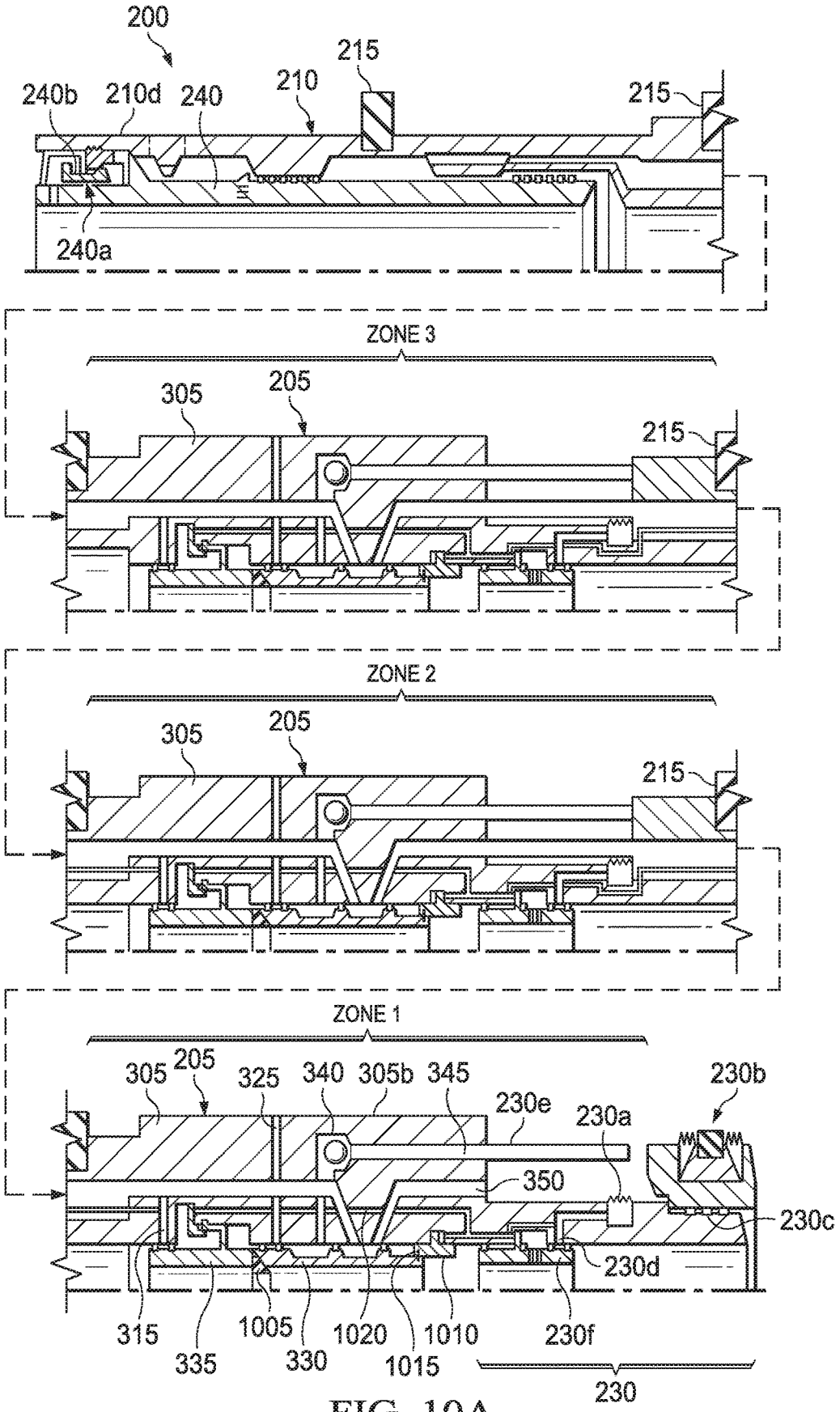
FIGS. 10A-10C illustrate an embodiment that uses a baffle seat assembly in the multi-functional well completion assemblies in multiple well completion assemblies within a wellbore.
Figure 10B:
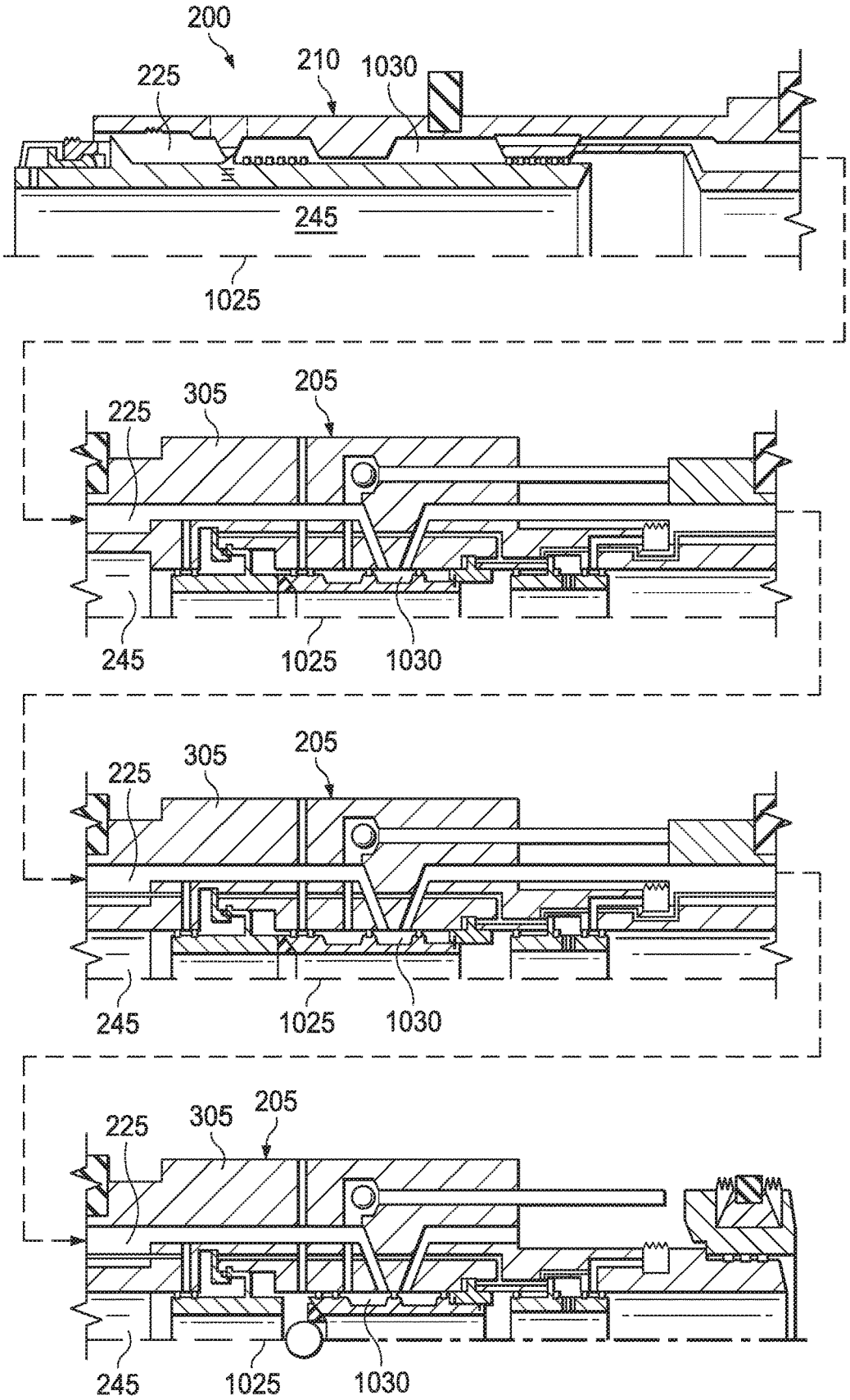
Figure 10C:
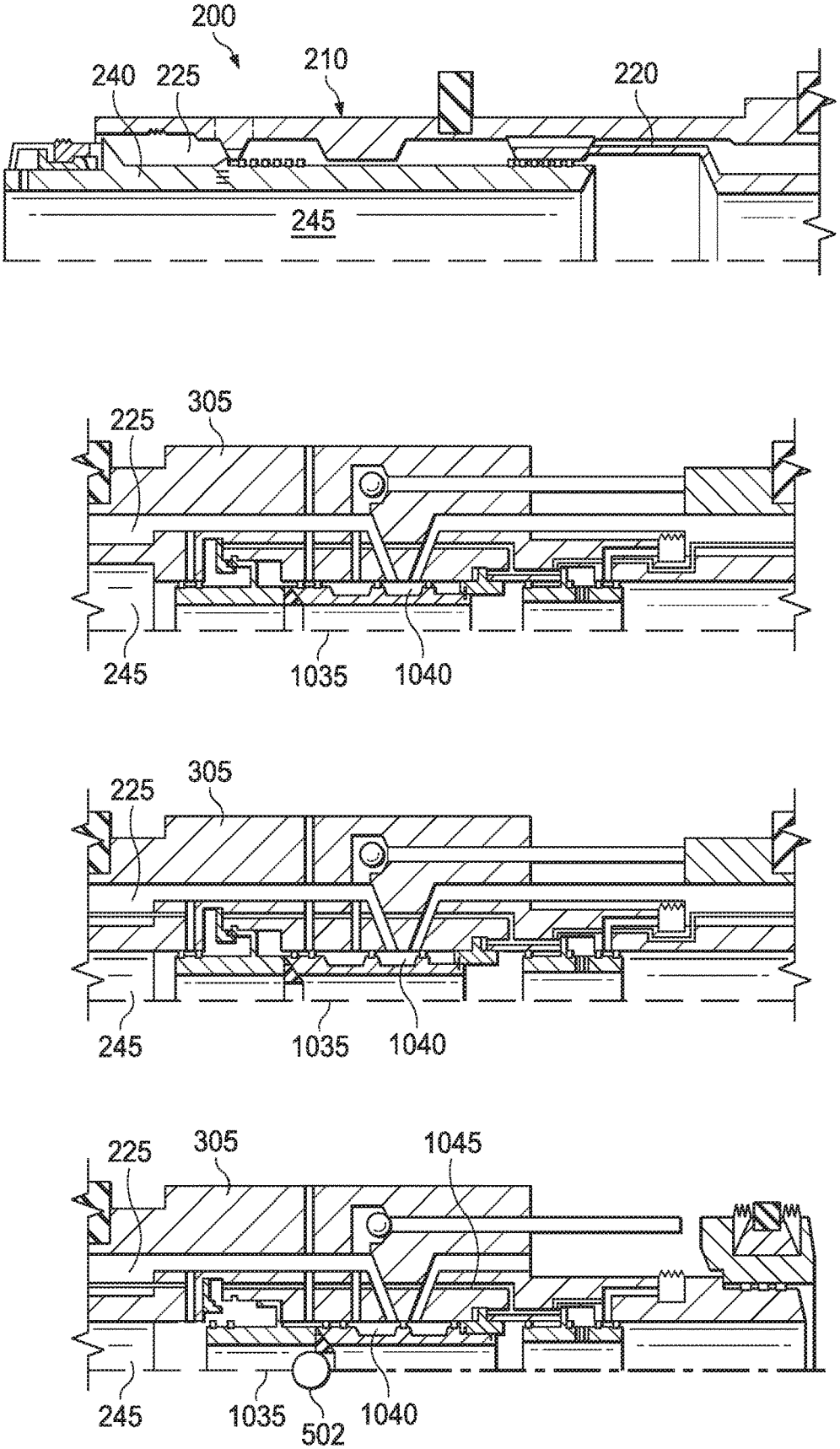

FIGS. 10A-10C are directed to an embodiment that uses a baffle seat assembly in the multi-functional well completion assembly 305 in multiple well completion assemblies 200 within a wellbore. It should be noted that these figures are half cross sections that are used for clarity in describing multiple well completion assemblies 200 coupled together in sequence. Similar components in the following figures will have the same reference numbers as previously used above with respect to other embodiments. The well completion assembly 200, in FIG. 10A, illustrates multiple well completions assemblies 200 coupled together to cover multiple zones. The well completion assembly 200 includes, among other features, the lower completion device 210, adapter tube 220, both of which are coupled to the upper most multi-functional well completion assembly 305 positioned within the wellbore, the production screen assembly 230, and the downhole packer 230*b*. The running tool 240 is removably coupled to the lower completion device 210, as previously discussed. According to the present disclosure, the running tool 240 may be used to position the well completion assembly 200 at a particular location within a subterranean oil/gas formation.

Once the running tool 240 is removably engaged with the lower well completion device 210, the running tool 240 may be used to position the well completion assembly 200 downhole such that it engages the downhole packer 230*b* that was set in previous operations. In one embodiment, seals 230*c* exist between a downhole end of well completion assembly 200 and the downhole packer 230*b*. The downhole packer 230*b* may comprise many different packers and remain within the scope of the disclosure. In the particular embodiment of FIG. 4, the downhole packer 230*b* is a sump packer.

The well completion assembly 200 illustrated in FIG. 10A is separated into Zone 1, Zone 2, and Zone 3. While the well completion device 200 has been illustrated as having three zones, those skilled in the art understand that the well completion device 200 may be manufactured with any configuration of one or more zones and remain within the scope of the present disclosure. Many different devices may be used to separate the different zones of a well completion assembly 200 manufactured according to the disclosure. For example, in the embodiment of FIG. 10A, a plurality of uphole packers 215 separate the different zones (e.g., assist in providing zonal isolation). The uphole packer 215 may comprise many different packers (e.g., hydraulic, swell, etc.) and achieve the desired zonal isolation. Thus, the present disclosure should not be limited to any specific uphole packer.

In the particular embodiment shown in FIG. 10A, each of the three zones are substantially identical to one another. Other embodiments exist, however, wherein each of the zones are not substantially identical to one another. In the embodiment of FIG. 10A, each of the zones may include the components of the well completion assembly 200, as previously discussed. Positioned between the frac sleeve 330 and the reverse sleeve 335, in the embodiment shown, is a ball seat 1005. The ball seat 1005 may comprise a baffle ball seat, as is shown in the illustrated FIG. 10A, or another type of ball seat. The ball seat 1005, in operation, is configured to engage a ball or other device that has been deployed within the well completion assembly 200 to activate one or more features thereof.

Each of the zones may additionally include a baffle deployment sleeve 1010, and in certain embodiments a retaining device 1015. While the retaining device 1015 is not absolutely necessary, it is helpful in maintaining the baffle deployment sleeve 1010 in the appropriate position at the appropriate operational stage. The retaining device 1015 is illustrated in FIG. 10A as a shear pin. Nevertheless, other retaining devices are within the scope of the present disclosure. Each of the zones may additionally include the dehydration or leak off tube 230*e* that has openings in it that are located adjacent its end and through which fluid can flow. Additionally, associated with the leak off tube 230*e* is the flow restrictor 340, as discussed above. In the illustrated embodiment, the flow restrictor 340 is located within the tubular member 305, however, in other embodiments, the flow restrictor 340 may be attached to the OD 305*b* of the tubular member 305, as discussed above.

Each of the zones may further include a screen 230*a*. The screen 230*a* may take on many different types, sizes and shapes and achieve its intended purpose. The screen 230*a* is illustrated in FIG. 10A as being placed radially inside the leak off tube 230*e*. However, other embodiments may exist wherein the screen 230*a* is placed radially outside of the leak off tube 230*e*. One skilled in the art would understand all the various different positions the screen 230*a* may be located and remain within the scope of the disclosure. While screens 320*a* have been illustrated, certain embodiments exist wherein the screens 230*a* are omitted.

In the embodiment shown, the screen 230*a* interfaces with the production port 230*d* on the production screen assembly 230 and the dehydration or leak off tube 230*e* to place an annular pack along the screen 230*a*. In accordance with the disclosure, the screen 230*a* may be a single joint or multiple joints using a cross coupling flow path. The dehydration or leak off tube 230*e* uses the flow restrictor 340 to allow flow to occur during dehydration of the gravel slurry, but when pressure is applied in the other direction the device prevents flow and allows the pressure to increase within a reverse flow path. The dehydration or leak off tube(s) 230*e* can be a tube installed outside of the screen 230*a* with filtered inlets along the dehydration or leak off tube 230*e* or at a single point. The sand retention can also occur at the screen 230*a* and the dehydration or leak off tube 230*e* can be housed inside the screen's 230*a* filter material to be a carrier of clean fluid only.

As explained above, the multi-functional well completion assemblies 205 located across from each of the zones may also include a plurality of ports and fluid passageways that couple many different features of the well completion assembly 200 with other features. For example, in the embodiment of FIG. 10A, each of the zones includes a production port 230*d*, a lateral frac fluid path 325, a second longitudinal path 350, a baffle deployment port 1020, and a first lateral fluid path 315. As is illustrated, the production sleeve 230*f* may slide along a longitudinal dimension of the well completion assembly 200, as explained above, to open and/or close the production port 230*d*. As is further illustrated, the frac sleeve 330 may slide along a longitudinal dimension of the multi-functional well completion assembly 205 to open and/or close the lateral frac fluid path 325. The baffle deployment port 1020 may provide pressurized fluid sufficient to cause the baffle deployment sleeve 1010 to slide along a longitudinal dimension of the well completion assembly 200 to deploy a next uphole ball seat 1005. The first lateral fluid path 315 also provides a port for the reverse out process.

Turning briefly to FIG. 10B, illustrated is the well completion assembly 200 of FIG. 10A further illustrating a forward or downhole circulation production path 1025 that runs through the central bore 245 of the well completion assembly 200 and an uphole circulation flow path 1030 that runs through the internal fluid paths of the multi-functional well completion assembly 205 and the concentric flow path 225. Turning briefly to FIG. 10C, illustrated is the well completion assembly 200 of FIG. 10A further illustrating a reverse circulation or uphole fluid path 1035 that runs through the central bore 245 of the well completion assembly 200 and a forward or downhole reverse circulation flow path 1040, and an activation flow path 1045 that run through the internal fluid paths of the multi-functional well completion assembly 205.

An additional flow path within the completion provides a means to flow fluid during treatment (live annulus, returns during packing, circulation tests, etc.), to reverse out slurry in the ID of the completion after treating, and a secondary path to apply hydraulic pressure to multi-functional sleeve assemblies and packers for actuation. A combination of dual base pipe geometry and axial communication ports along the outer circumference of each frac sleeve can generate the reverse flow path in the sand faced completion. Alternatively, the reverse path could be created using a smaller tube(s) internal or external to the completion assembly (i.e. shunt tubes).

Each of the individual FIGS. 10-11 will now be discussed so as to understand the operation of the illustrated embodiment of the well completion assembly 200. Multi-functional sleeve assemblies allow a multi-zone wellbore to be stimulated without the use of a service tool or downhole electronics. The sleeves allow communication between the completion ID and OD to selectively move from closed to open and back closed again without service tool intervention. During these operational steps, the sleeve also alters a separate reverse flow path specified in the sequence below.

The well completion assembly 200 illustrated in FIG. 10A depicts the state of operation thereof as the well completion assembly 200 has just been deployed downhole using the running tool 240, or in a so called run in hole (RIH) position. Thus, as illustrated in FIG. 10A, the running tool 240 is engaged with the landing head 210*d* of the well completion assembly 200. More specifically, in the embodiment of FIG. 10A, the running tool activation sleeve 240*b* is initially pinned in place such that a profile thereof pushes radially outward on the coupling mechanism 240*a* of the running tool 240, which in turn engages a coupling mechanism 210*c* in the landing head 210*d* of the lower completion device 210. While one particular embodiment has been illustrated for the engagement of the landing head 210*d* and the running tool 240, those skilled in the art understand that other mechanisms could be used and remain within the scope of the disclosure.

As the running tool 240 and the lower completion device 210 are fixedly engaged with one another, the running tool 240 may be used to seat the lower completion device 210 with the downhole packer 230*b*, which in turn isolates the well completion assembly 200 from well features below the downhole packer 230*b*. Other embodiments may exist wherein no downhole packer 230*b* is used, and a bullnose, float shoe, or another isolation method could be used. In yet another embodiment, the lower completion device 210 has an integrated downhole packer device, which creates the aforementioned isolation.

Further illustrated in FIG. 10A, the uphole packers 215 are deployed to isolate the different zones of the lower completion device 210. For example, in the embodiment of FIG. 10A, the uphole packers 215 are hydraulic packer devices or swellable packer devices that may be deployed using fluid pressure. For example, the uphole packers 215 may be set, in one embodiment, by applying fluid pressure through the production string against the downhole packer 230*b* (e.g., in some embodiments using a reverse path of the lower completion device 210). In another embodiment, a small ball could be dropped within the production string to engage a shearable seat inside the seals 230*c*, which would have the added benefit of avoiding an upward piston force during the lower completion device 210 setting process. While the uphole packers 215 are configured in this embodiment to be deployed at the same time, other embodiments may exist wherein the uphole packers 215 are separately and independently deployed. Those skilled in the art would understand what modifications would be necessary to the lower completion device 210 of FIG. 10A to achieve this separate and independent deployment scheme. When deployed, the uphole packers 215 extend radially outward against the wellbore.

In the operational state of FIG. 10A, Zones 2 and 3 are substantially identical to one another, and Zone 1 only differs slightly from Zones 2 and 3. For example, the Zone 1 ball seat 1005 is deployed such that it extends radially inward. In this deployed state, the ball seat 1005 in Zone 1 is configured to engage or otherwise collect a sealing ball that has been deployed from uphole. As the ball seats 1005 of Zones 2 and 3 are in the undeployed state, the sealing ball 502 (See FIG. 10C) passes by them without any engagement. Thus, a single ball size can be used to activate each well completion assembly associated with each zone.

Figure 11:
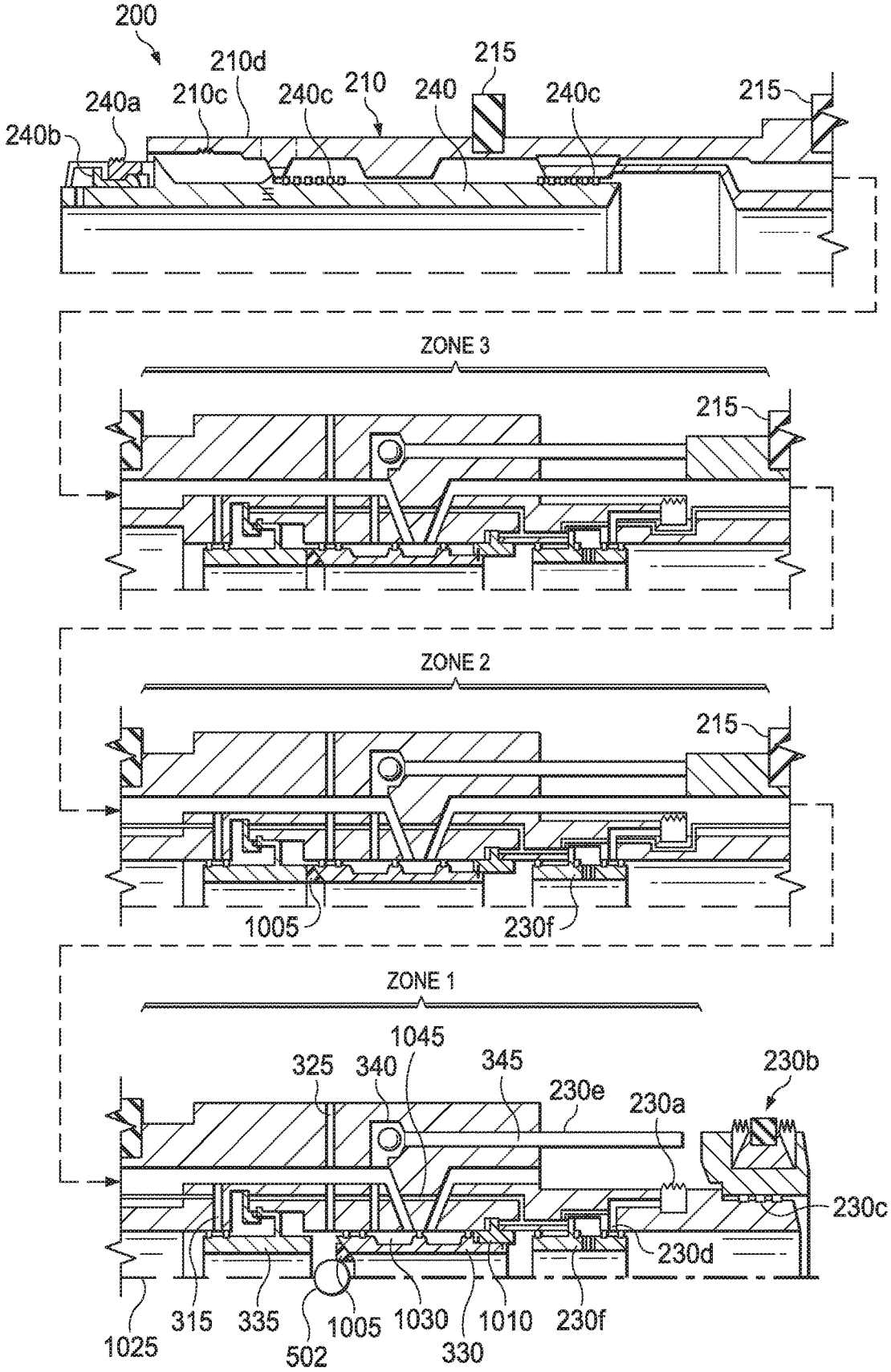
FIG. 11, illustrates an embodiment of the well completion assembly in a Zone 1 treatment operational state with a sealing ball having been dropped within the wellbore and through the production string, wherein it engages the Zone 1 ball seat.

Turning to FIG. 11, illustrated is the well completion assembly 200 in a Zone 1 treatment operational state. As illustrated, a sealing ball 502 has been dropped within the wellbore and through the production string, wherein it engages the Zone 1 ball seat 1005. As the sealing ball 502 engages the Zone 1 ball seat 1005, the ball 502 isolates the main fluid path above the sealing ball 502 from the main fluid path below the sealing ball 502. Accordingly, Zone 1 has been effectively isolated from those well features there below.

With the sealing ball 502 seated with the Zone 1 ball seat 1005, fluid pressure may be applied through the forward circulation flow path 1025 to shift the frac sleeve 330 to open the lateral frac fluid path 325. In the illustrated embodiment, the frac sleeve 330 is shifted downhole to open the lateral frac fluid path 325, but those skilled in the art understand that other configurations different from that illustrated are within the scope of the disclosure. At the same time, the Zone 1 dehydration or leak off tube 230*e* is now fluidly connected to Zone 1 and the Zone 1 flow restrictor 340 to the uphole circulation flow path 1030. Additionally, this also opens communication between the downhole reverse circulation flow path 1040 and the activation flow path 1045 for the production sleeve 230*f* of the current zone and the ball seat 1005 in the zone above (e.g., zone 2 in this embodiment). With the well completion assembly 200 in the operational state of FIG. 11, treatment may begin, and returns may be taken through the dehydration or leak off tube 230*e*, if inducing a screenout is required. Zone 1 is typically pumped until a screen out is achieved. To assist with reaching a true annular pack with a screenout, the aforementioned dehydration or leak off tube 230*e* allows the frac fluid 602 to be dehydrated by transporting carrier fluid through the reverse flow path back to surface, if desired by the operator.

Figure 12:
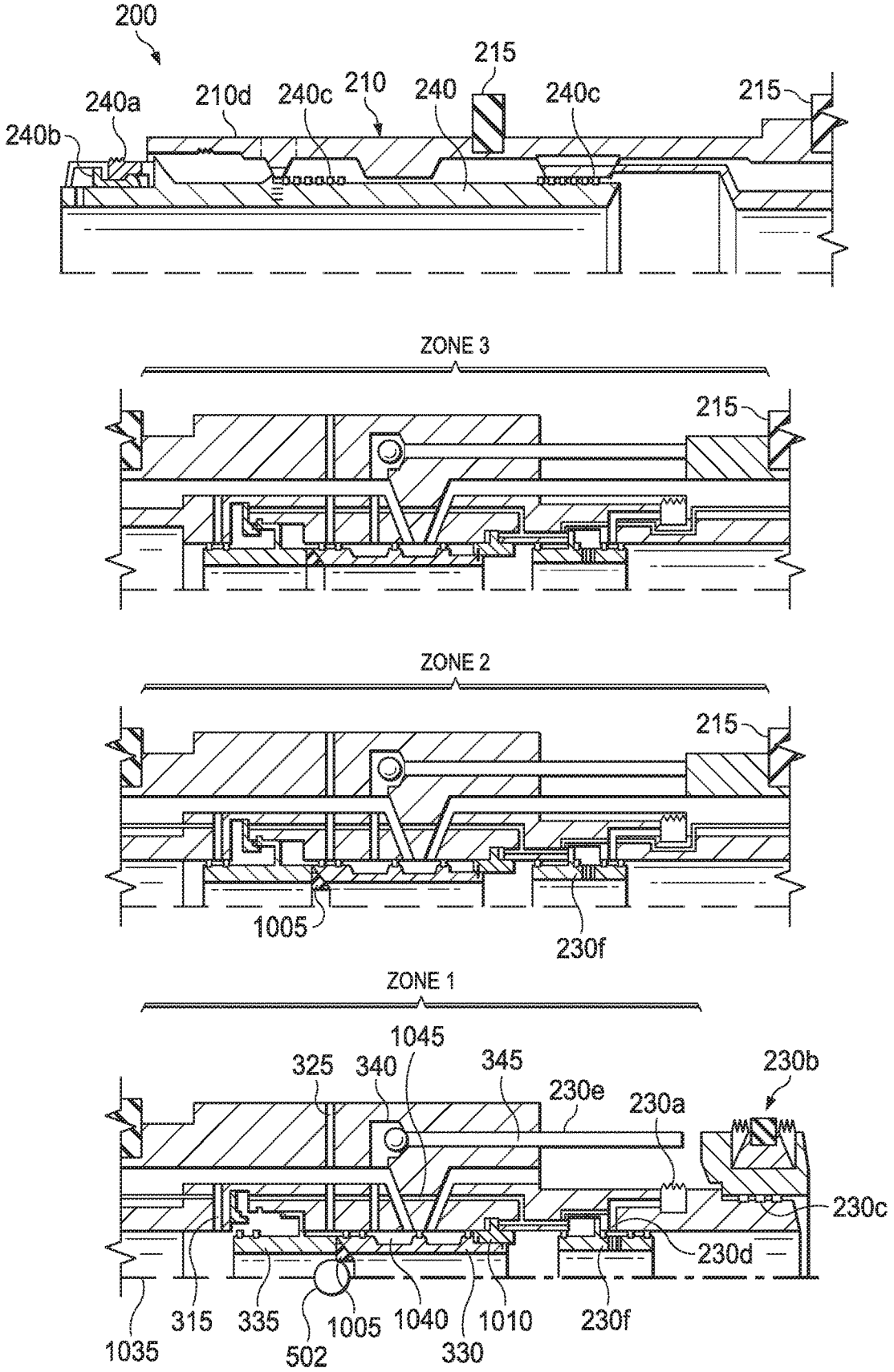
FIG. 12, illustrates an embodiment of the well completion assembly in a Zone 1 reverse out operational state.

Turning to FIG. 12, illustrated is the well completion assembly 200 in a Zone 1 reverse out operational state. As illustrated, the Zone 1 sealing ball 502 is still engaged with the Zone 1 ball seat 1005. In the Zone 1 reverse out operational state, annulus pressure is applied to the reverse circulation or uphole flow path 1040. When applied in this manner, fluid pressure from the forward or downhole reverse circulation fluid path 1040 builds against the flow restrictor 340 in the second longitudinal path 350. When the pressure increases to a first value, Zone 2 baffle deployment sleeve 1010 shifts to deploy the Zone 2 ball seat 1005. When the pressure increases to a second higher value, the Zone 1 production sleeve 230*f* shifts to open the Zone 1 production port 230*d*. Moreover, as the pressure continues to increase to a third higher value, the Zone 1 reverse sleeve 335 shifts to expose the first lateral fluid path 315, and the Zone 1 lateral frac fluid path 325 closes. Those skilled in the art understand how the well completion assembly 210 may be manufactured to achieve the aforementioned three pressure actuation. In one example embodiment, the first pressure ranges from about 250 psi to about 750 psi, the second higher pressure ranges from about 750 psi to about 1250 psi, and the third higher pressure ranges from about 1250 psi to about 1750 psi. Nevertheless, the present disclosure should not be limited to any specific number of pressure changes or any specific pressure ranges. For instance, the lower completion device 210 may be manufactured for less than a three pressure actuation, and in fact a two pressure actuation works well. Moreover, the present disclosure should not be limited to any order of activation for the various sleeves, and in fact the activation order may easily be changed. With the lower completion device 210 in the operational state of FIG. 12, reverse out may begin, and returns may be taken through the production tubing.

Figure 13:
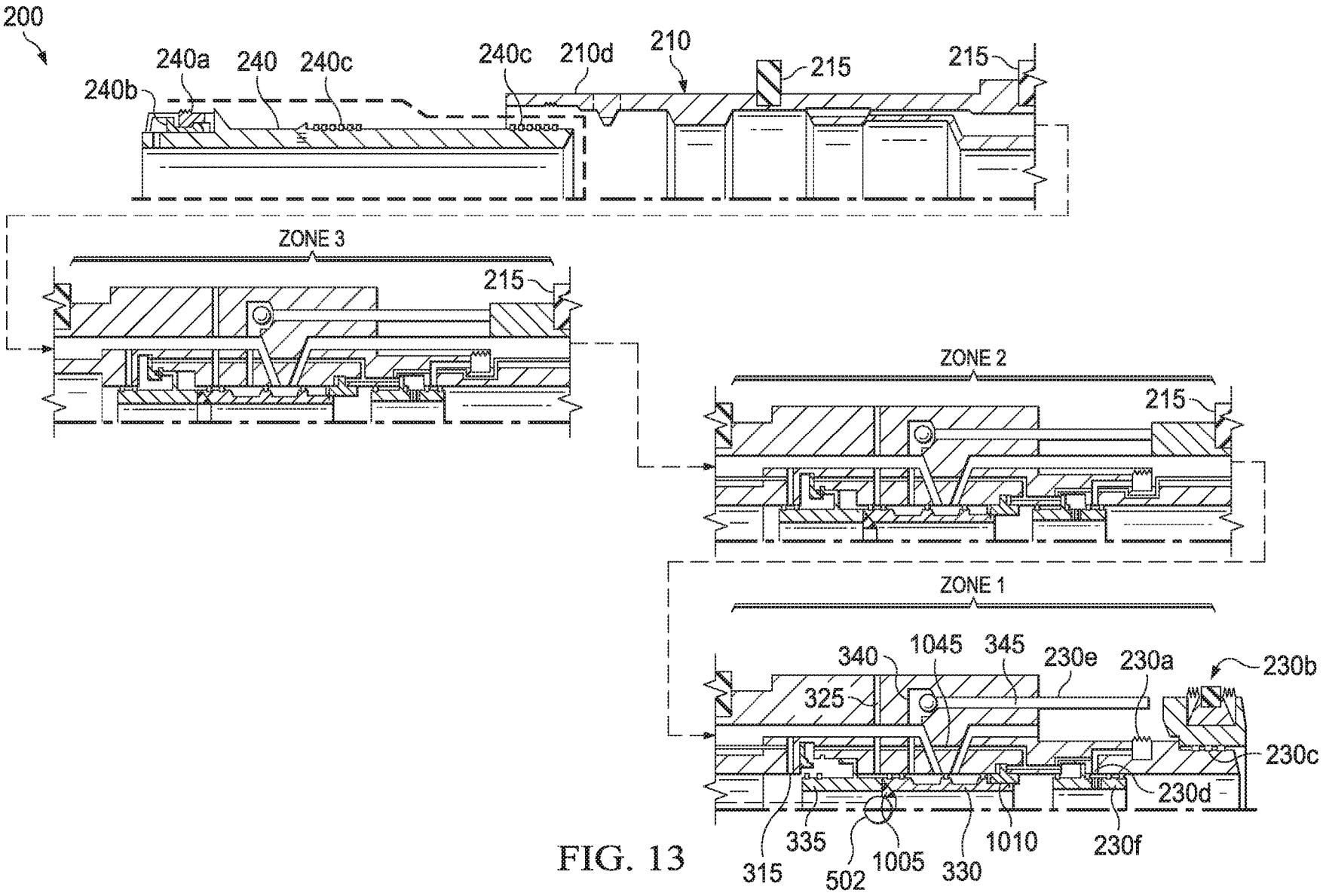
FIG. 13, illustrates an embodiment of the well completion assembly in a Zone 1 full reverse out operational state.

Turning to FIG. 13, illustrated is the well completion assembly 200 in a Zone 1 full reverse out operational state. As shown in FIG. 13, the running tool 240 has disengaged from the landing head 210*d* of the lower completion device 210, and thereafter been lifted above an inner diameter of the lower completion device 210. When in this position, a full reverse rate may be achieved, as the flow path is more direct and less tortuous. Such an operational state is helpful, if not necessary, to remove excess proppant in the workstring after proppant is appropriately placed in the formation outside of the lower completion device 210.

Figure 14:
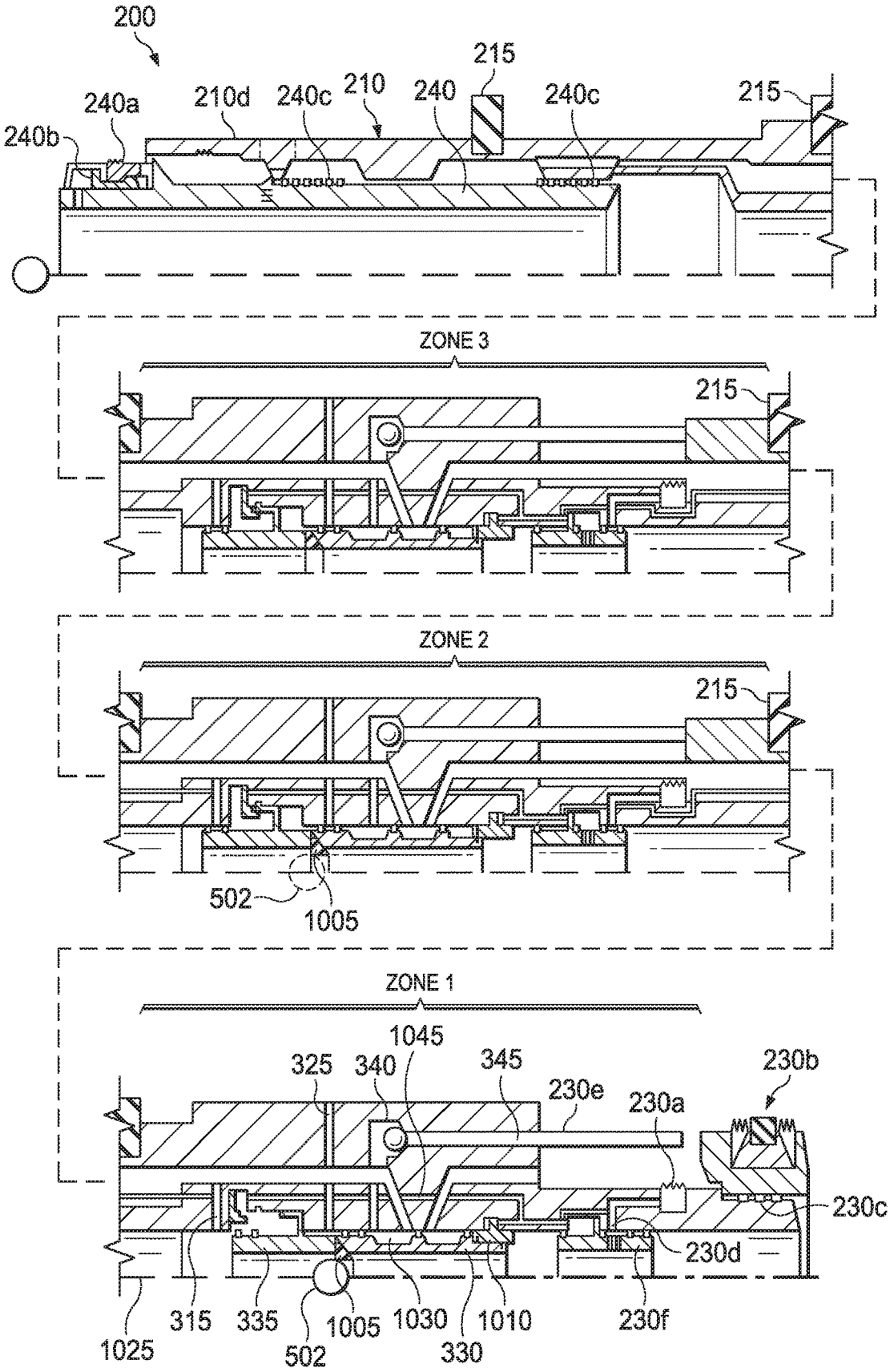
FIG. 14 illustrates an embodiment where a second sealing ball has been deployed within the production tubing to seat with the Zone 2 ball seat.

Turning to FIG. 14, a second sealing ball 502 has been deployed within the production tubing to seat with the Zone 2 ball seat 1005. In this embodiment, as shown, fluid circulation down the forward or downhole circulation production path 1025 may pass through the Zone 1 first lateral fluid path 315 to assist the Zone 2 second sealing ball 502 to fall on the Zone 2 ball seat 1005. With the Zone 2 sealing ball 502 appropriately engaged with the Zone 2 ball seat 1005, the process could sequentially repeat itself with regard to Zone 2, Zone 3, Zone 4, etc.

The invention having been generally described, the following embodiments are given by way of illustration and are not intended to limit the specification of the claims in any manner/

Embodiments herein comprise:

A multi-functional well completion apparatus, comprising: a tubular member that has a wall and an outer diameter (OD) and an inner diameter (ID), and a central bore extending there through and defined by the ID. The central bore forms a central fluid path into and out of the tubular member. The tubular member further comprises a longitudinal fluid path that is located within the wall and has a first end that opens at an uphole end of the tubular member and a second end that opens into the central bore. A first lateral fluid path is located within the wall and has a first end that opens into the central bore and a second end that opens into the longitudinal fluid path. A second lateral fluid path is located within the wall and has a first end that opens into the central bore and a second end that either extends to the OD or terminates within the wall. A lateral frac fluid path extends from the central bore to the OD. A frac sleeve slidably engages within the central bore and has a set of seal elements associated therewith that sealingly engage the ID of the tubular member and annular grooves located between the set of seal elements. The frac sleeve is slidable to a frac position within the central bore that establishes a fracking fluid path from the central bore to a wellbore annulus and fluidly connects the second lateral fluid path with the longitudinal fluid path. A reverse sleeve is slidably engaged within the central bore and has a set of seal elements associated therewith that sealingly engages the ID of the tubular member and is slidable to a reverse out position within the central bore to establish a fluid path between the central bore and the longitudinal fluid path by way of the first lateral fluid path.

Another embodiment is directed to a method of operating a multi-functional completion apparatus. In this embodiment, the method comprises coupling a multi-functional completion apparatus to a tubing string to form a completion assembly and running the completion assembly into a wellbore. The multi-functional completion apparatus comprises a tubular member that has a wall and an outer diameter (OD) and an inner diameter (ID), and a central bore extending there through and defined by the ID, the central bore forming a central fluid path into and out of the tubular member. The tubular member further comprises a longitudinal fluid path located within the wall that has a first end that opens at an uphole end of the tubular member and a second end that opens into the central bore. A first lateral fluid path is located within the wall and has a first end that opens into the central bore and a second end that opens into the longitudinal fluid path. A second lateral fluid path is located within the wall and has a first end that opens into the central bore and a second end that either extends to the OD or terminates within the wall. A lateral frac fluid path extends from the central bore to the OD. A frac sleeve is slidably engaged within the central bore and has a set of seal elements associated there with that sealingly engage the ID of the tubular member and annular grooves located between the set of seal elements. The frac sleeve is slidable to a frac position within the central bore that establishes a fracking fluid path from the central bore to a wellbore annulus and that fluidly connects the second lateral fluid path with the longitudinal fluid path. A reverse sleeve is slidably engaged within the central bore of the tubular member and has a set of seal elements associated therewith that sealingly engage the ID of the tubular member and is slidable to a reverse out position within the central bore of the tubular member to establish a fluid path between the central bore of the tubular member and the longitudinal fluid path by way of the first lateral fluid path. A lower completion tube is coupled to an uphole end of the tubular member, and an adapter tube is coupled to the uphole end of the tubular member and is received within the lower completion tube, and wherein coupling includes removably coupling a running tool, having an outer diameter that is receivable within the lower completion tube and the adapter tube, to the lower completion tube, the coupling providing an annular concentric fluid path between the outer diameter of the running tool and inner diameters of the lower completion tube and the adapter tube. Opening the fracking fluid path by moving the frac sleeve downhole to the frac position to provide a fluid path from the central bore of the tubular member, through the lateral frac fluid path and into an annulus of the wellbore, the opening further providing a circulation fluid path through a second lateral fluid path space between one of the annular grooves and the ID, through the longitudinal fluid path, and into the concentric fluid path. Pumping a frac fluid downhole through a central bore of the running tool and the tubing string, through the lateral frac fluid path and into the annulus of a well; and returning a filtered frac fluid uphole through the concentric fluid path.

Another embodiment is directed to A well completion apparatus, comprising a tubular member having a wall and an outer diameter (OD) and an inner diameter (ID), and a central bore extending there through and defined by the ID. The central bore forms a central fluid path into and out of the tubular member. The tubular member further comprising a longitudinal fluid path located within the wall that has a first end that opens at an uphole end of the tubular member and a second end that opens into the central bore. A first lateral path is located within the wall and has a first end that opens into the central bore and a second end that opens into the longitudinal fluid path. A second lateral fluid path is located within the wall and has a first end that opens into the central bore and a second end that either extends to the OD or terminates within the wall and has lateral frac fluid path that extends from the central bore to the OD. A frac sleeve is slidably engaged within the central bore and has a set of seal elements associated therewith that sealingly engage the ID of the tubular member and annular grooves located between the set of seal elements. The frac sleeve is slidable to a frac position within the central bore that establishes a fracking fluid path from the central bore to a wellbore annulus and that fluidly connects the second lateral fluid path with the longitudinal fluid path, A reverse sleeve is slidably engaged within the central bore and has a set of seal elements associated there with that sealingly engage the ID of the tubular member and is slidable to a reverse out position within the central bore to establish a fluid path between the central bore and the longitudinal fluid path by way of the first lateral path. A lower completion tube has an inner diameter and is coupled to an uphole end of the tubular member. An adapter tube and has an inner diameter and coupled to the uphole end of the tubular member and being received within the lower completion tube. A running tool having an outer diameter and is received within the lower completion tube and the adapter tube and is removably coupled to the lower completion tube. The running tool, the lower completion tube, and the adapter tube providing an annular concentric fluid path between the outer diameter of the running tool and the inner diameters of the lower completion tube and the adapter tube. A tubing string is coupled to the lower completion tube.

Element 1: further comprising a flow restrictor coupled to the tubular member and the second end of the second lateral fluid path, and being fluidly connectable to a zone of a wellbore and the longitudinal fluid path when the frac sleeve is in the frac position and forms a fluid path through the wall of the tubular member by way of the second lateral fluid path and the longitudinal fluid path.

Element 2: wherein the second lateral fluid path extends to the OD of the tubular member and the flow restrictor is externally coupled to the OD of the tubular member at the second end of the second lateral fluid path.

Element 3: wherein the flow restrictor is located within the wall and the second end of the second lateral fluid path opens into the flow restrictor to form a fluid path from the flow restrictor to the central bore.

Element 4: wherein the longitudinal fluid path is a first longitudinal fluid path and the multi-functional well completion apparatus further comprises a leak-off port located within the wall of the tubular member that extends from the flow restrictor to a downhole end of the tubular member.

Element 5: wherein the longitudinal fluid path and the second lateral fluid path are fluidly connectable to each other through the frac sleeve when the frac sleeve is in the frac position, the seal elements of the frac sleeve forming a sealed fluid path between the ID of the central bore and an outer diameter of the frac sleeve.

Element 6: wherein the frac sleeve includes a ball seat located on an uphole end thereof and having a diameter that prevents a sealing ball having a diameter larger than the diameter of the ball seat to pass there through.

Element 7: further comprising an actuation valve located within an actuation chamber within the wall and associated with the reverse sleeve to move the reverse sleeve to the reverse out position.

Element 8: wherein the longitudinal fluid path is a first longitudinal fluid path and the multi-functional well completion apparatus further comprises a second longitudinal fluid path located within the wall of the tubular member downhole from the first longitudinal fluid path, and having a first end that terminates at the ID of the tubular member and a second end that terminates at a downhole end of the tubular member, and wherein the location of the second end of the first longitudinal fluid path relative to the first end of the second longitudinal fluid path being such that when the frac sleeve is in the frac position, the frac sleeve fluidly disconnects the first longitudinal fluid path from the second longitudinal fluid path.

Element 9: further comprising a baffle ball seat located between opposing ends of the frac sleeve and the reverse sleeve and configured to extend into the central bore and allow a sealing ball to seat thereon.

Element 10: further comprising a ball seat deployment sleeve located downhole from the frac sleeve that is slidable within a piston chamber formed within the ID wall of the tubular member and a baffle deployment port that connects the baffle ball seat with the piston chamber to allow the baffle ball seat to be selectively deployed.

Element 11: wherein the opening includes placing a sealing ball on a ball seat of an uphole end of the frac sleeve and applying pressure against the sealing ball to cause the frac sleeve to move to the frac position.

Element 12: wherein at least first and second multiple multi-functional completion apparatus are coupled together in sequence and the ball seat of an uphole end of the frac sleeve is a first ball seat on an uphole end of a first frac sleeve and the sealing ball is a first sealing ball, and the method further comprises: placing a second sealing ball on a second ball seat of a second frac sleeve of the second multi-functional completion apparatus located uphole from the first multi-functional completion apparatus, the second ball seat being configured to retain the second sealing ball thereon, the second ball seat and the second sealing ball each having a respective diameter that is larger than a diameter of the sealing ball and ball seat of the frac sleeve of the first well completion apparatus, subsequent to removing a fracking fluid from the central bore of the running tool and the tubing string.

Element 13: wherein the multi-functional completion apparatus further comprises a baffle ball seat located between opposing ends of the frac sleeve and the reverse sleeve and a ball seat deployment sleeve located downhole from the frac sleeve that is slidable within a piston chamber formed within the ID wall of the tubular member and a baffle deployment port that connects the baffle ball seat with the piston chamber to allow the baffle ball seat to be selectively deployed, and the method further comprises selectively deploying the baffle ball seat prior to the placing the sealing ball.

Element 14: wherein at least first and second multiple multi-functional completion apparatus are coupled together in sequence and the baffle ball seat is a first baffle seat and the sealing ball is a first sealing ball, and the method further comprises selectively deploying a second baffle ball seat prior to placing a placing a second sealing ball on a second ball seat of a second frac sleeve of the second multi-functional completion apparatus located uphole from the first multi-functional completion apparatus, the second ball seat being configured to retain the second sealing ball thereon, the second ball.

Element 15: further comprising unlatching the running tool from the lower completion tube and lifting the running tool uphole to cause it to seal against a seal bore within the interior diameter of the adapter tube prior to the placing the sealing ball.

Element 16: wherein the lifting is a first lifting and the method further comprises lifting the running tool a second time to a point where a downhole end of the running tool is adjacent an uphole end of the lower completion tube subsequent to moving the reverse sleeve to the reverse out position, the lifting decreasing a fluid flow path length thereby increasing a flow rate of the fracking fluid.

Element 17: wherein the multi-functional completion apparatus further comprises a production sleeve located downhole of the frac sleeve, and the method further comprises shifting the production sleeve to a production position subsequent to removing the fracking fluid.

Element 18: further comprising removing fracking fluid from a central bore of the running tool and tubing string subsequent to the opening of the fracking fluid path by moving the reverse sleeve to the reverse out position and pumping a fluid downhole through the concentric fluid path, longitudinal fluid path, through the first lateral fluid path and uphole through the central bore of the running tool and the tubing string.

Element 19: wherein the multi-functional completion apparatus further comprises: a flow restrictor coupled to the tubular member and being selectively connectable to: a zone of a wellbore, the second lateral fluid path, and the longitudinal fluid path when the frac sleeve is in the frac position to form a fluid path through the tubular member, and wherein the returning further comprises returning the filtered frac fluid through the flow restrictor, through the second lateral fluid path, through the longitudinal fluid path and into the concentric fluid path.

Element 20: wherein the lower completion tube comprises spaced apart packers located uphole and downhole of the multi-functional completion apparatus, and the method further comprises setting the packers prior to opening the fracking fluid path to isolate a zone of the wellbore located between the packers.

Element 21 wherein setting the packers includes pumping a setting fluid downhole through the central bore of the running tool and the tubing.

Element 22: wherein shifting the frac sleeve to the frac position includes establishing a fluid path between the longitudinal fluid path and the second lateral fluid path by way of one of the annular grooves of the frac sleeve.

Element 23: wherein shifting further includes disconnecting a fluid path between the longitudinal fluid path and a second longitudinal fluid path that extends from the ID of the tubular member to a downhole end of the tubular member.

Element 24: further comprising a flow restrictor coupled to the tubular member and the second end of the second lateral fluid path, and being fluidly connectable to a zone of a wellbore and the longitudinal fluid path, when the frac sleeve is in the frac position, to form a fluid path through the tubular member by way of the second lateral fluid path and the longitudinal fluid path.

Element 25: wherein the flow restrictor is located within the wall and the second end of the second lateral fluid path opens into the flow restrictor to form a fluid path from the flow restrictor to the central bore.

Element 26: wherein the longitudinal fluid path is a first longitudinal fluid path and the multi-functional completion apparatus further comprises a leak-off port located within the wall of the tubular member that extends from the flow restrictor to a downhole end of the tubular member.

Element 27: wherein the second lateral fluid path extends to the OD of the tubular member and the flow restrictor is externally coupled to the tubular member at the second end of the second lateral fluid path.

Element 28: wherein the longitudinal fluid path and the second lateral fluid path are fluidly connectable to each other through the frac sleeve when the frac sleeve is in the frac position, the seal elements of the frac sleeve forming a sealed fluid path between the ID of the central bore and an outer diameter of the frac sleeve.

Element 29: wherein the frac sleeve includes a ball seat located on an uphole end thereof and having a diameter that prevents a sealing ball having a diameter larger than the diameter of the ball seat to pass there through.

Element 30: further comprising a baffle ball seat located between opposing ends of the frac sleeve and the reverse sleeve and configured to extend into the central bore and allow a sealing ball to seat thereon.

Element 31: further comprising a ball seat deployment sleeve located downhole from the frac sleeve that is slidable within a piston chamber formed within the ID wall of the tubular member and a baffle deployment port that connects the baffle ball seat with the piston chamber to allow the baffle ball seat to be selectively deployed.

Element 32: further comprising an actuation valve located within an actuation chamber within the wall and associated with the reverse sleeve to move the reverse sleeve to the reverse out position.

Element 33: further comprising a production sleeve slidably located downhole of the frac sleeve and engaged within the central bore and having a set of seal elements associated therewith that sealingly engage the ID of the tubular member and being slidable to a production position.

Element 34: wherein the longitudinal fluid path is a first longitudinal fluid path and the multi-functional completion apparatus further comprises a second longitudinal fluid path located within the wall of the tubular member downhole from the first longitudinal fluid path, and having a first end that terminates at the ID of the tubular member and a second end that terminates at a downhole end of the tubular member, and wherein the location of the second end of the first longitudinal fluid path relative to the first end of the second longitudinal fluid path being such that when the frac sleeve is in the frac position, the frac sleeve fluidly disconnects the first longitudinal fluid path from the second longitudinal fluid path.

Those skilled in the art to which this application relates will appreciate that other and further additions, deletions, substitutions and modifications may be made to the described embodiments.

What is claimed is:

1. A multi-functional well completion apparatus, comprising:

a tubular member having a wall and an outer diameter (OD) and an inner diameter (ID), and a central bore extending there through and defined by the ID, the central bore forming a central fluid path into and out of the tubular member, the tubular member further comprising:

a longitudinal fluid path located within the wall and having a first end that opens at an uphole end of the tubular member and a second end that opens into the central bore;

a first lateral fluid path located within the wall and having a first end that opens into the central bore and a second end that opens into the longitudinal fluid path;

a second lateral fluid path located within the wall and having a first end that opens into the central bore and a second end that either extends to the OD or terminates within the wall; and a lateral frac fluid path that extends from the central bore to the OD;

a frac sleeve slidably engaged within the central bore and having a set of seal elements associated therewith that sealingly engage the ID of the tubular member and annular grooves located between the set of seal elements, the frac sleeve being slidable to a frac position within the central bore that establishes a fracking fluid path from the central bore to a wellbore annulus and that fluidly connects the second lateral fluid path with the longitudinal fluid path; and a reverse sleeve slidably engaged within the central bore and having a set of seal elements associated therewith that sealingly engages the ID of the tubular member and being slidable to a reverse out position within the central bore to establish a fluid path between the central bore and the longitudinal fluid path by way of the first lateral fluid path.

2. The multi-functional well completion apparatus of claim 1, further comprising a flow restrictor coupled to the tubular member and the second end of the second lateral fluid path, and being fluidly connectable to a zone of a wellbore and the longitudinal fluid path when the frac sleeve is in the frac position and forms a fluid path through the wall of the tubular member by way of the second lateral fluid path and the longitudinal fluid path.

3. The multi-functional well completion apparatus of claim 2, wherein the second lateral fluid path extends to the OD of the tubular member and the flow restrictor is externally coupled to the OD of the tubular member at the second end of the second lateral fluid path.

4. The multi-functional well completion apparatus of claim 2, wherein the flow restrictor is located within the wall and the second end of the second lateral fluid path opens into the flow restrictor to form a fluid path from the flow restrictor to the central bore.

5. The multi-functional well completion apparatus of claim 4, wherein the longitudinal fluid path is a first longitudinal fluid path and the multi-functional well completion apparatus further comprises a leak-off port located within the wall of the tubular member that extends from the flow restrictor to a downhole end of the tubular member.

6. The multi-functional well completion apparatus of claim 1, wherein the longitudinal fluid path and the second lateral fluid path are fluidly connectable to each other through the frac sleeve when the frac sleeve is in the frac position, the seal elements of the frac sleeve forming a sealed fluid path between the ID of the central bore and an outer diameter of the frac sleeve.

7. The multi-functional well completion apparatus of claim 1, wherein the frac sleeve includes a ball seat located on an uphole end thereof and having a diameter that prevents a sealing ball having a diameter larger than the diameter of the ball seat to pass there through.

8. The multi-functional well completion apparatus of claim 1, further comprising an actuation valve located within an actuation chamber within the wall and associated with the reverse sleeve to move the reverse sleeve to the reverse out position.

9. The multi-functional well completion apparatus of claim 1, wherein the longitudinal fluid path is a first longitudinal fluid path and the multi-functional well completion apparatus further comprises a second longitudinal fluid path located within the wall of the tubular member downhole from the first longitudinal fluid path, and having a first end that terminates at the ID of the tubular member and a second end that terminates at a downhole end of the tubular member, and wherein the location of the second end of the first longitudinal fluid path relative to the first end of the second longitudinal fluid path being such that when the frac sleeve is in the frac position, the frac sleeve fluidly disconnects the first longitudinal fluid path from the second longitudinal fluid path.

10. The multi-functional well completion apparatus of claim 1, further comprising a baffle ball seat located between opposing ends of the frac sleeve and the reverse sleeve and configured to extend into the central bore and allow a sealing ball to seat thereon.

11. The multi-functional well completion apparatus of claim 10, further comprising a ball seat deployment sleeve located downhole from the frac sleeve that is slidable within a piston chamber formed within the ID wall of the tubular member and a baffle deployment port that connects the baffle ball seat with the piston chamber to allow the baffle ball seat to be selectively deployed.

12. A method of operating a multi-functional completion apparatus, comprising:

coupling a multi-functional completion apparatus to a tubing string to form a completion assembly and running the completion assembly into a wellbore, the multi-functional completion apparatus comprising:

a tubular member having a wall and an outer diameter (OD) and an inner diameter (ID), and a central bore extending there through and defined by the ID, the central bore forming a central fluid path into and out of the tubular member, the tubular member further comprising;

a longitudinal fluid path located within the wall and having a first end that opens at an uphole end of the tubular member and a second end that opens into the central bore;

a first lateral fluid path located within the wall and having a first end that opens into the central bore and a second end that opens into the longitudinal fluid path;

a second lateral fluid path located within the wall and having a first end that opens into the central bore and a second end that either extends to the OD or terminates within the wall; and a lateral frac fluid path that extends from the central bore to the OD;

a frac sleeve slidably engaged within the central bore and having a set of seal elements associated therewith that sealingly engage the ID of the tubular member and annular grooves located between the set of seal elements, the frac sleeve being slidable to a frac position within the central bore that establishes a fracking fluid path from the central bore to a wellbore annulus and that fluidly connects the second lateral fluid path with the longitudinal fluid path; and a reverse sleeve slidably engaged within the central bore of the tubular member and having a set of seal elements associated therewith that sealingly engage the ID of the tubular member and being slidable to a reverse out position within the central bore of the tubular member to establish a fluid path between the central bore of the tubular member and the longitudinal fluid path by way of the first lateral fluid path;

a lower completion tube coupled to an uphole end of the tubular member; and an adapter tube coupled to the uphole end of the tubular member and being received within the lower completion tube, and wherein coupling includes removably coupling a running tool, having an outer diameter that is receivable within the lower completion tube and the adapter tube, to the lower completion tube, the coupling providing an annular concentric fluid path between the outer diameter of the running tool and inner diameters of the lower completion tube and the adapter tube;

opening the fracking fluid path by moving the frac sleeve downhole to the frac position to provide a fluid path from the central bore of the tubular member, through the lateral frac fluid path and into an annulus of the wellbore, the opening further providing a circulation fluid path through a second lateral fluid path space between one of the annular grooves and the ID, through the longitudinal fluid path, and into the concentric fluid path;

pumping a frac fluid downhole through a central bore of the running tool and the tubing string, through the lateral frac fluid path and into the annulus of a well; and returning a filtered frac fluid uphole through the concentric fluid path.

13. The method of claim 12, wherein the opening includes placing a sealing ball on a ball seat of an uphole end of the frac sleeve and applying pressure against the sealing ball to cause the frac sleeve to move to the frac position.

14. The method of claim 13, wherein at least first and second multiple multi-functional completion apparatus are coupled together in sequence and the ball seat of an uphole end of the frac sleeve is a first ball seat on an uphole end of a first frac sleeve and the sealing ball is a first sealing ball, and the method further comprises:

placing a second sealing ball on a second ball seat of a second frac sleeve of the second multi-functional completion apparatus located uphole from the first multi-functional completion apparatus, the second ball seat being configured to retain the second sealing ball thereon, the second ball seat and the second sealing ball each having a respective diameter that is larger than a diameter of the sealing ball and ball seat of the frac sleeve of the first well completion apparatus, subsequent to removing a fracking fluid from the central bore of the running tool and the tubing string.

15. The method of claim 13, wherein the multi-functional completion apparatus further comprises a baffle ball seat located between opposing ends of the frac sleeve and the reverse sleeve and a ball seat deployment sleeve located downhole from the frac sleeve that is slidable within a piston chamber formed within the ID wall of the tubular member and a baffle deployment port that connects the baffle ball seat with the piston chamber to allow the baffle ball seat to be selectively deployed, and the method further comprises selectively deploying the baffle ball seat prior to the placing the sealing ball.

16. The method of claim 15, wherein at least first and second multiple multi-functional completion apparatus are coupled together in sequence and the baffle ball seat is a first baffle seat and the sealing ball is a first sealing ball, and the method further comprises selectively deploying a second baffle ball seat prior to placing a placing a second sealing ball on a second ball seat of a second frac sleeve of the second multi-functional completion apparatus located uphole from the first multi-functional completion apparatus, the second ball seat being configured to retain the second sealing ball thereon, the second ball.

17. The method of claim 13, further comprising unlatching the running tool from the lower completion tube and lifting the running tool uphole to cause it to seal against a seal bore within the interior diameter of the adapter tube prior to the placing the sealing ball.

18. The method of claim 17, wherein the lifting is a first lifting and the method further comprises lifting the running tool a second time to a point where a downhole end of the running tool is adjacent an uphole end of the lower completion tube subsequent to moving the reverse sleeve to the reverse out position, the lifting decreasing a fluid flow path length thereby increasing a flow rate of the fracking fluid.

19. The method of claim 12 wherein the multi-functional completion apparatus further comprises a production sleeve located downhole of the frac sleeve, and the method further comprises shifting the production sleeve to a production position subsequent to removing the fracking fluid.

20. The method of claim 12, further comprising removing fracking fluid from a central bore of the running tool and tubing string subsequent to the opening of the fracking fluid path by moving the reverse sleeve to the reverse out position and pumping a fluid downhole through the concentric fluid path, longitudinal fluid path, through the first lateral fluid path and uphole through the central bore of the running tool and the tubing string.

21. The method of claim 12, wherein the multi-functional completion apparatus further comprises:

a flow restrictor coupled to the tubular member and being selectively connectable to a zone of a wellbore, the second lateral fluid path, and the longitudinal fluid path when the frac sleeve is in the frac position to form a fluid path through the tubular member, and wherein the returning further comprises returning the filtered frac fluid through the flow restrictor, through the second lateral fluid path, through the longitudinal fluid path and into the concentric fluid path.

22. The method of claim 12, wherein the lower completion tube comprises spaced apart packers located uphole and downhole of the multi-functional completion apparatus, and the method further comprises setting the packers prior to opening the fracking fluid path to isolate a zone of the wellbore located between the packers.

23. The method of claim 22, wherein setting the packers includes pumping a setting fluid downhole through the central bore of the running tool and the tubing.

24. The method of claim 12, wherein shifting the frac sleeve to the frac position includes establishing a fluid path between the longitudinal fluid path and the second lateral fluid path by way of one of the annular grooves of the frac sleeve.

25. The method of claim 24, wherein shifting further includes disconnecting a fluid path between the longitudinal fluid path and a second longitudinal fluid path that extends from the ID of the tubular member to a downhole end of the tubular member.

26. A well completion apparatus, comprising:

a tubular member having a wall and an outer diameter (OD) and an inner diameter (ID), and a central bore extending there through and defined by the ID, the central bore forming a central fluid path into and out of the tubular member, the tubular member further comprising:

a longitudinal fluid path located within the wall and having a first end that opens at an uphole end of the tubular member and a second end that opens into the central bore;

a first lateral path located within the wall and having a first end that opens into the central bore and a second end that opens into the longitudinal fluid path;

a second lateral fluid path located within the wall and having a first end that opens into the central bore and a second end that either extends to the OD or terminates within the wall; and a lateral frac fluid path that extends from the central bore to the OD;

a frac sleeve slidably engaged within the central bore and having a set of seal elements associated therewith that sealingly engage the ID of the tubular member and annular grooves located between the set of seal elements, the frac sleeve being slidable to a frac position within the central bore that establishes a fracking fluid path from the central bore to a wellbore annulus and that fluidly connects the second lateral fluid path with the longitudinal fluid path;

a reverse sleeve slidably engaged within the central bore and having a set of seal elements associated therewith that sealingly engage the ID of the tubular member and being slidable to a reverse out position within the central bore to establish a fluid path between the central bore and the longitudinal fluid path by way of the first lateral path;

a lower completion tube having an inner diameter and being coupled to an uphole end of the tubular member;

an adapter tube and having an inner diameter and coupled to the uphole end of the tubular member and being received within the lower completion tube;

a running tool having an outer diameter and received within the lower completion tube and the adapter tube and being removably coupled to the lower completion tube, the running tool, the lower completion tube and the adapter tube providing an annular concentric fluid path between the outer diameter of the running tool and the inner diameters of the lower completion tube and the adapter tube; and a tubing string coupled to the lower completion tube.

27. The well completion apparatus of claim 26 further comprising a flow restrictor coupled to the tubular member and the second end of the second lateral fluid path, and being fluidly connectable to a zone of a wellbore and the longitudinal fluid path, when the frac sleeve is in the frac position, to form a fluid path through the tubular member by way of the second lateral fluid path and the longitudinal fluid path.

28. The well completion apparatus of claim 27, wherein the flow restrictor is located within the wall and the second end of the second lateral fluid path opens into the flow restrictor to form a fluid path from the flow restrictor to the central bore.

29. The well completion apparatus of claim 28, wherein the longitudinal fluid path is a first longitudinal fluid path and the multi-functional completion apparatus further comprises a leak-off port located within the wall of the tubular member that extends from the flow restrictor to a downhole end of the tubular member.

30. The well completion apparatus of claim 29, wherein the second lateral fluid path extends to the OD of the tubular member and the flow restrictor is externally coupled to the tubular member at the second end of the second lateral fluid path.

31. The well completion apparatus of claim 26, wherein the longitudinal fluid path and the second lateral fluid path are fluidly connectable to each other through the frac sleeve when the frac sleeve is in the frac position, the seal elements of the frac sleeve forming a sealed fluid path between the ID of the central bore and an outer diameter of the frac sleeve.

32. The well completion apparatus of claim 26, wherein the frac sleeve includes a ball seat located on an uphole end thereof and having a diameter that prevents a sealing ball having a diameter larger than the diameter of the ball seat to pass there through.

33. The well completion apparatus of claim 26, further comprising a baffle ball seat located between opposing ends of the frac sleeve and the reverse sleeve and configured to extend into the central bore and allow a sealing ball to seat thereon.

34. The well completion apparatus of claim 33, further comprising a ball seat deployment sleeve located downhole from the frac sleeve that is slidable within a piston chamber formed within the ID wall of the tubular member and a baffle deployment port that connects the baffle ball seat with the piston chamber to allow the baffle ball seat to be selectively deployed.

35. The well completion apparatus of claim 26, further comprising an actuation valve located within an actuation chamber within the wall and associated with the reverse sleeve to move the reverse sleeve to the reverse out position.

36. The well completion apparatus of claim 26, further comprising a production sleeve slidably located downhole of the frac sleeve and engaged within the central bore and having a set of seal elements associated therewith that sealingly engage the ID of the tubular member and being slidable to a production position.

37. The well completion apparatus of claim 26, wherein the longitudinal fluid path is a first longitudinal fluid path and the multi-functional completion apparatus further comprises a second longitudinal fluid path located within the wall of the tubular member downhole from the first longitudinal fluid path, and having a first end that terminates at the ID of the tubular member and a second end that terminates at a downhole end of the tubular member, and wherein the location of the second end of the first longitudinal fluid path relative to the first end of the second longitudinal fluid path being such that when the frac sleeve is in the frac position, the frac sleeve fluidly disconnects the first longitudinal fluid path from the second longitudinal fluid path.

* * * * *